US008157980B2

(12) United States Patent
Davidson

(10) Patent No.: US 8,157,980 B2
(45) **Date of Patent: *Apr. 17, 2012**

(54) MULTI-CELL DUAL VOLTAGE ELECTROLYSIS APPARATUS AND METHOD OF USING SAME

(75) Inventor: Nehemia Davidson, Rosh-Haavin (IL)

(73) Assignee: Nehemia Davidson (IL)

( * ) Notice: Subject to any disclaimer, the term of this patent is extended or adjusted under 35 U.S.C. 154(b) by 1016 days.

This patent is subject to a terminal disclaimer.

(21) Appl. No.: 12/151,291

(22) Filed: May 6, 2008

(65) Prior Publication Data

US 2008/0296167 A1 Dec. 4, 2008

(30) Foreign Application Priority Data

May 30, 2007 (CA) ..... 2590493

(51) Int. Cl.
*C02F 1/46* (2006.01)

(52) U.S. Cl. ..... 205/637; 205/638; 204/253; 204/230.2

(58) Field of Classification Search ..... 205/637–639; 204/253, 230.2
See application file for complete search history.

(56) References Cited

U.S. PATENT DOCUMENTS 7,611,618 B2 * 11/2009 Davidson ..... 205/341
7,615,138 B2 * 11/2009 Davidson ..... 204/230.7

* cited by examiner

*Primary Examiner* — Arun S Phasge
(74) *Attorney, Agent, or Firm* — Patent Law Office of David G. Beck

(57) ABSTRACT

A method and apparatus for achieving high output efficiency from an electrolysis system (100) using a plurality of electrolysis cells all located within a single electrolysis tank (101) is provided. Each individual electrolysis cell includes a membrane (105A) and at least one pair of low voltage electrodes of different polarity (115A/116A). The electrolysis system also includes at least one pair of high voltage electrodes (119A/120A). In at least one embodiment, the low voltage electrodes within each electrolysis cell are comprised of at least one pair of low voltage electrodes of a first type (115A/116A) and at least one pair of low voltage electrodes of a second type (117A/118A). In at least one other embodiment, the low voltage electrodes within each electrolysis cell are comprised of at least one pair of low voltage electrodes (701A/702A). The voltage applied to the electrodes is pulsed.

24 Claims, 15 Drawing Sheets

MULTI-CELL DUAL VOLTAGE ELECTROLYSIS APPARATUS AND METHOD OF USING SAME

CROSS-REFERENCE TO RELATED APPLICATION

Under 35 U.S.C. 119, the present application claims the benefit of the earlier filing date and the right of priority to Canadian Patent Application Serial No. 2,590,493, filed May 30, 2007, the disclosure of which is hereby incorporated by reference for any and all purposes.

FIELD OF THE INVENTION

The present invention relates generally to electrolysis systems and, more particularly, to a high efficiency electrolysis system and methods of using same.

BACKGROUND OF THE INVENTION

Fossil fuels, in particular oil, coal and natural gas, represent the primary sources of energy in today's world. Unfortunately in a world of rapidly increasing energy needs, dependence on any energy source of finite size and limited regional availability has dire consequences for the world's economy. In particular, as a country's need for energy increases, so does its vulnerability to disruption in the supply of that energy. Additionally, as fossil fuels are the largest single source of carbon dioxide emissions, a greenhouse gas, continued reliance on such fuels can be expected to lead to continued global warming. Accordingly it is imperative that alternative, clean and renewable energy sources be developed that can replace fossil fuels.

Hydrogen-based fuel is currently one of the leading contenders to replace fossil fuel. However in order to successfully transition from oil-based and coal-based fuels to a hydrogen-based fuel, significant improvements must be made in terms of hydrogen production, hydrogen storage and distribution, and hydrogen engines. Clearly the state of the art in each of these developmental areas impacts the other areas. For example, if a method of inexpensively producing hydrogen in small production plants can be developed, production plants can be situated close to the end user, thus avoiding the need for extremely complex and costly distribution systems.

Although a number of techniques can be used to produce hydrogen, the primary technique is by steam reforming natural gas. In this process thermal energy is used to react natural gas with steam, creating hydrogen and carbon dioxide. Although this process is well developed, due to its reliance on fossil fuels and the release of carbon dioxide during production, it does not alleviate the need for fossil fuels nor does it lower the environmental impact of its use over that of traditional fossil fuels. Other, less developed hydrogen producing techniques include (i) biomass fermentation in which methane fermentation of high moisture content biomass creates fuel gas, a small portion of which is hydrogen; (ii) biological water splitting in which certain photosynthetic microbes produce hydrogen from water during their metabolic activities; (iii) photoelectrochemical processes using either soluble metal complexes as a catalyst or semiconducting electrodes in a photochemical cell; (iv) thermochemical water splitting using chemicals such as bromine or iodine, assisted by heat, to split water molecules; (v) thermolysis in which concentrated solar energy is used to generate temperatures high enough to split methane into hydrogen and carbon; and (vi) electrolysis.

Electrolysis as a means of producing hydrogen has been known and used for over 80 years. In general, electrolysis of water uses two electrodes separated by an ion conducting electrolyte. During the process hydrogen is produced at the cathode and oxygen is produced at the anode, the two reaction areas separated by an ion conducting diaphragm. Electricity is required to drive the process. An alternative to conventional electrolysis is high temperature electrolysis, also known as steam electrolysis. This process uses heat, for example produced by a solar concentrator, as a portion of the energy required to cause the needed reaction. Although lowering the electrical consumption of the process is desirable, this process has proven difficult to implement due to the tendency of the hydrogen and oxygen to recombine at the technique's high operating temperatures.

Although a variety of improvements have been devised to improve upon the efficiency of the electrolytic hydrogen production system, to date none of them have been able to make the process efficient enough to make hydrogen-based fuel a viable alternative to fossil fuels. Accordingly, what is needed in the art is a means for efficiently producing hydrogen, the means preferably being small enough to minimize the need for an overly complex distribution system. The present invention provides such a system and method of use.

SUMMARY OF THE INVENTION

The present invention provides a method and apparatus for achieving high output efficiency from an electrolysis system using a plurality of electrolysis cells all located within a single electrolysis tank. Each individual electrolysis cell includes a membrane which separates the portion of the electrolysis tank containing that electrolysis cell into two regions. In at least one embodiment, the system is further comprised of at least one pair of high voltage electrodes including at least one high voltage anode and at least one high voltage cathode and positioned within the electrolysis tank such that all of the individual electrolysis cells are interposed between the at least one high voltage anode and the at least one high voltage cathode, wherein each electrolysis cell is further comprised of at least one pair of low voltage electrodes of a first type and at least one pair of low voltage electrodes of a second type. In at least one other embodiment, the system is further comprised of at least one pair of high voltage electrodes including at least one high voltage anode and at least one high voltage cathode and positioned within the electrolysis tank such that all of the individual electrolysis cells are interposed between the at least one high voltage anode and the at least one high voltage cathode, wherein each electrolysis cell is further comprised of at least one pair of low voltage electrodes. In at least one other embodiment, each electrolysis cell is further comprised of at least one pair of low voltage electrodes of a first type, at least one pair of low voltage electrodes of a second type and at least one pair of high voltage electrodes. In at least one other embodiment, each electrolysis cell is further comprised of at least one pair of low voltage electrodes and at least one pair of high voltage electrodes.

The high voltage electrodes are connected to a high voltage source while the low voltage electrodes are connected to either a single low voltage source or to multiple low voltage sources. In at least one embodiment, the low voltage electrodes of each electrolysis cell are connected to a different low voltage source. In at least one embodiment in which each electrolysis cell includes two types of low voltage electrodes, one low voltage source is connected to one of the types of low voltage electrodes while a second low voltage source is connected to the other type of low voltage electrodes.

The power supplied by both the low and high voltage sources is simultaneously pulsed, preferably at a frequency between 50 Hz and 1 MHz, and more preferably at a frequency of between 100 Hz and 10 kHz. The pulse duration is preferably between 0.01 and 75 percent of the time period defined by the frequency, and more preferably between 1 and 50 percent of the time period defined by the frequency. Preferably the ratio of the high voltage to the low voltage is at least 5:1, more preferably within the range of 5:1 to 100:1, still more preferably within the range of 5:1 to 33:1, and still more preferably within the range of 5:1 to 20:1. Preferably the low voltage is between 3 and 1500 volts, more preferably between 12 and 750 volts. Preferably the high voltage is between 50 volts and 50 kilovolts, more preferably between 100 volts and 5 kilovolts.

Preferably the liquid within the tank is comprised of one or more of; water, deuterated water, tritiated water, semiheavy water, heavy oxygen water, and/or any other water containing an isotope of either hydrogen or oxygen. Preferably the liquid within the electrolysis tank includes an electrolyte with a concentration in the range of 0.05 to 10 percent by weight, more preferably in the range of 0.05 to 2.0 percent by weight, and still more preferably in the range of 0.1 to 0.5 percent by weight.

The electrodes can be fabricated from a variety of materials, although preferably the material for each electrode is selected from the group consisting of steel, nickel, copper, iron, stainless steel, cobalt, manganese, zinc, titanium, platinum, palladium, aluminum, lithium, magnesium, boron, carbon, graphite, carbon-graphite, metal hydrides and alloys thereof. If the electrolysis cells include two types of low voltage electrodes, preferably the two types are comprised of different materials.

In at least one embodiment, the electrolysis system is cooled. Cooling is preferably achieved by thermally coupling at least a portion of the electrolysis system to a portion of a conduit containing a heat transfer medium. The conduit can surround the electrolysis tank, be integrated within the walls of the electrolysis tank, or be contained within the electrolysis tank.

In at least one embodiment, the electrolysis system also contains a system controller. The system controller can be used to perform system optimization, either during an initial optimization period or repeatedly throughout system operation.

A further understanding of the nature and advantages of the present invention may be realized by reference to the remaining portions of the specification and the drawings.

DESCRIPTION OF THE SPECIFIC EMBODIMENTS

Figure 1:
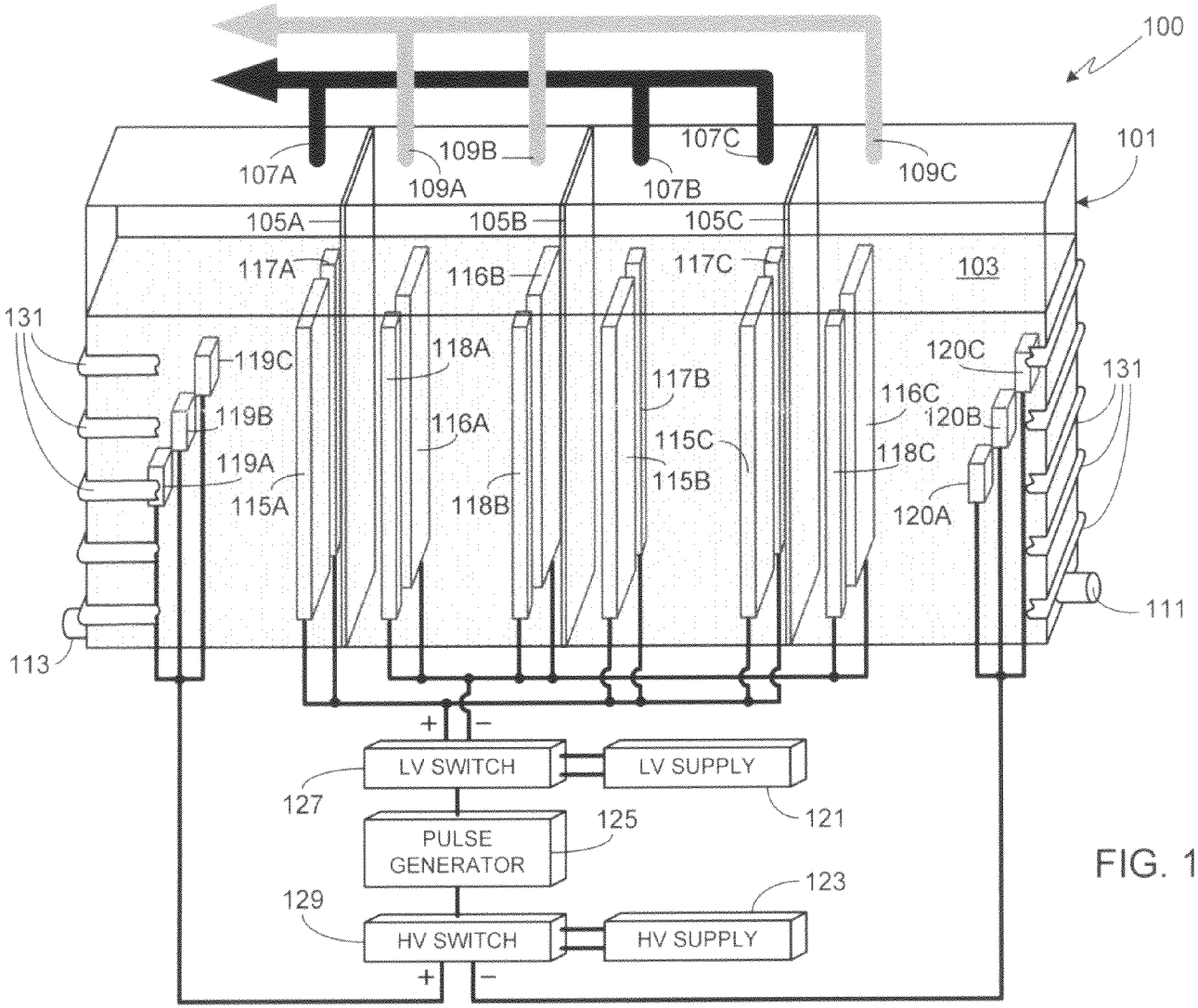
FIG. 1 is an illustration of an exemplary embodiment of the invention utilizing a three cell configuration.

FIG. 1 is an illustration of an exemplary, and preferred, embodiment of the invention which is used to produce hydrogen at a high rate. Electrolysis system 100 includes a tank 101 comprised of a non-conductive material, the size of the tank depending primarily upon the desired output level for the system, for example the desired quantity/flow rate of hydrogen to be generated. Although tank 101 is shown as having a rectangular shape, it will be appreciated that the invention is not so limited and that tank 101 can utilize other shapes, for example cylindrical, square, irregularly-shaped, etc. Tank 101 is substantially filled with liquid 103. In at least one preferred embodiment, liquid 103 is comprised of water with an electrolyte, the electrolyte being either an acid electrolyte or a base electrolyte. Exemplary electrolytes include potassium hydroxide and sodium hydroxide. The term "water" as used herein refers to water ($H_2O$), deuterated water (deuterium oxide or $D_2O$), tritiated water (tritium oxide or $T_2O$), semiheavy water (HDO), heavy oxygen water ($H_2{}^{18}O$ or $H_2{}^{17}O$) or any other water containing an isotope of either hydrogen or oxygen, either singly or in any combination thereof (for example, a combination of $H_2O$ and $D_2O$).

A typical electrolysis system used to decompose water into hydrogen and oxygen gases utilizes relatively high concentrations of electrolyte. The present invention, however, has been found to work best with relatively low electrolyte concentrations, thereby maintaining a relatively high initial water resistivity. Preferably the water resistivity prior to the addition of an electrolyte is on the order of 1 to 28 megohms. Preferably the concentration of electrolyte is in the range of 0.05 percent to 10 percent by weight, more preferably the concentration of electrolyte is in the range of 0.05 percent to 2.0 percent by weight, and still more preferably the concentration of electrolyte is in the range of 0.1 percent to 0.5 percent by weight.

Tank 101 includes multiple electrolysis cells, an electrolysis cell defined herein as having at least one pair of low voltage electrodes of different polarities separated by a membrane. Accordingly the embodiment illustrated in FIG. 1 includes three electrolysis cells. It should be understood that the invention is not limited to an electrolysis system with a specific number of cells, rather the number of cells depends primarily on the desired output level (e.g., hydrogen flow rate) and the size of the electrolysis tank. Separating each cell into two regions is a membrane, specifically membranes 105A-105C in the illustrated embodiment. As used throughout this specification in describing the accompanying figures, alphanumeric symbols with the same numeral refer to the same type of component. Thus, for example, 105A and 105B both refer to a cell membrane, but of two different cells.

Membranes 105A-105C permit ion/electron exchange between the two regions of each cell while keeping separate the oxygen and hydrogen bubbles produced during electrolysis. Maintaining separate hydrogen and oxygen gas regions is important not only as a means of allowing the collection of pure hydrogen gas and pure oxygen gas, but also as a means of minimizing the risk of explosions due to the inadvertent recombination of the two gases. Accordingly similar polarity electrodes are grouped together with the membranes keeping groups separate. Thus in the exemplary embodiment shown in FIG. 1, only anodes are positioned between membrane 105A and the left side of electrolysis tank 101; only cathodes are positioned between membranes 105A and 105B; only anodes are positioned between membranes 105B and 105C; and only cathodes are positioned between membrane 105C and the right side of electrolysis tank 101. Exemplary membrane materials include, but are not limited to, polypropylene, tetrafluoroethylene, asbestos, etc.

As noted herein, the present system is capable of generating considerable heat. Accordingly, system components such as the electrolysis tank (e.g., tank 101) and the membranes (e.g., membranes 105A-105C) that are expected to be subjected to the heat generated by the system must be fabricated from suitable materials and designed to indefinitely accommodate the intended operating temperatures as well as the internal tank pressure. For example, in at least one preferred embodiment the system is designed to operate at a temperature of approximately 90° C. at standard pressure. In an alternate exemplary embodiment, the system is designed to operate at elevated temperatures (e.g., 100° C. to 150° C.) and at sufficient pressure to prevent boiling of liquid 103. In yet another alternate exemplary embodiment, the system is designed to operate at even higher temperatures (e.g., 200° C. to 350° C.) and higher pressures (e.g., sufficient to prevent boiling). Accordingly, it will be understood that the choice of materials (e.g., for tank 101 and membranes 105A-105C) and the design of the system (e.g., tank wall thicknesses, fittings, etc.) will vary, depending upon the intended system operational parameters, primarily temperature and pressure.

Other standard features of the electrolysis tank are gas outlets for the hydrogen and oxygen gases. In the exemplary embodiment shown in FIG. 1, the oxygen gas produced at the anodes will exit tank 101 at gas outlets 107A-107C while hydrogen gas produced at the cathodes will exit the tank at gas outlets 109A-109C. Replenishment of liquid 103 is preferably through a separate conduit, for example conduit 111. In at least one embodiment of the invention, another conduit 113 is used to remove liquid 103 from the system. Alternately, each cell can include one or more conduits for liquid 103 replenishment. If desired, a single conduit can be used for both liquid removal and replenishment. It will be appreciated that the system can either be periodically refilled or liquid 103 can be continuously added at a very slow rate during system operation.

It is understood that a system utilizing electrolysis system 100 to produce hydrogen will also include means for either storing the produced gases, e.g., hydrogen storage tanks, or means for delivering the produced gas to the point of consumption, e.g., pipes and valves, as well as flow gauges, pressure gauges, gas compressors, gas driers, gas purifiers, water purifiers, water pumps, etc.

In at least one preferred embodiment of the electrolysis system of the invention, and as illustrated in the exemplary embodiment of FIG. 1, three types of electrodes are used, each type of electrode being comprised of one or more electrode pairs with each electrode pair including a cathode (i.e., a cathode coupled electrode) and an anode (i.e., an anode coupled electrode). As previously noted, throughout the electrolysis tank cathodes are grouped together and anodes are grouped together, electrode groups being separated by membranes.

In the embodiment illustrated in FIG. 1, each cell includes at least one pair of low voltage electrodes of a first type and at least one pair of low voltage electrodes of a second type, with preferably both types of low voltage electrodes being coupled to the same voltage source. In the illustrated embodiment, electrode pairs of the first type are labeled 115A/116A, 115B/116B and 115C/116C where each electrode labeled 115 is an anode and each electrode labeled 116 is a cathode. The electrode pairs of the second type are labeled 117A/118A, 117B/118B and 117C/118C where each electrode labeled 117 is an anode and each electrode labeled 118 is a cathode. The third type of electrodes are high voltage electrodes. Although the high voltage electrodes can be comprised of a single anode and a single cathode, in the embodiment illustrated in FIG. 1 there are three high voltage anodes 119A-119C and three high voltage cathodes 120A-120C.

In FIG. 1, low voltage power source 121 supplies power to all of the low voltage electrodes and high voltage power source 123 supplies power to all of the high voltage electrodes. As described and illustrated, voltage source 121 is referred to and labeled as a 'low' voltage source not because of the absolute voltage produced by the source, but because the output of voltage source 121 is maintained at a lower output voltage than the output of voltage source 123.

Preferably and as shown, the faces of the individual electrodes of each pair of electrodes are parallel to one another; i.e., the face of electrode 115A is parallel to the face of electrode 116A, the face of electrode 117A is parallel to the face of electrode 118A, the face of electrode 119A is parallel to the face of electrode 120A, etc. Additionally, and as shown, in at least one preferred embodiment the anodes and cathodes of each pair of low voltage electrodes of the first type, and of each pair of low voltage electrodes of the second type, are not positioned directly across from one another. Thus low voltage anode 115A of the first type is opposite low voltage cathode 118A of the second type, low voltage anode 117A of the second type is opposite low voltage cathode 116A of the first type, etc. Although not shown, it should be understood that the invention can also operate with electrodes of the same type being opposite one another, e.g., electrode 115A being opposite 116A, etc.

Although electrode pairs 115A-C/116A-C and 117A-C/118A-C are both low voltage electrodes and are preferably coupled to the same voltage supply, these electrode pairs are quite different in terms of composition and in some embodiments, also in terms of size. In one preferred embodiment, electrodes 115A-C/116A-C are comprised of titanium while electrodes 117A-C/118A-C are comprised of steel. It should be appreciated, however, that other materials can be used as long as electrodes 115A-C/116A-C are made up of a different material from electrodes 117A-C/118A-C. In addition to titanium and steel, other exemplary materials that can be used for electrodes 115A-C, 116A-C, 117A-C, and 118A-C include, but are not limited to, copper, iron, stainless steel, cobalt, manganese, zinc, nickel, platinum, palladium, aluminum, lithium, magnesium, boron, carbon, graphite, carbon-graphite, metal hydrides and alloys of these materials. As used in the present specification, a metal hydride refers to any compound of a metal and hydrogen or an isotope of hydrogen (e.g., deuterium, tritium).

Preferably the faces of electrodes 115A and 117A are coplanar as are the faces of electrodes 116A and 118A, electrodes 115B and 117B, electrodes 116B and 118B, electrodes 115C and 117C, and electrodes 116C and 118C. Also preferably, the combined area made up by the faces of the two side-by-side electrodes of different types (e.g., 115A and 117A, 116A and 118A, 115B and 117B, etc.) cover a large percentage of the cross-sectional area of tank 101. In an exemplary embodiment, the combined area of the faces of each pair of side-by-side electrodes of different type cover between 70 percent and 90 percent of the cross-sectional area of the electrolysis tank. Although not required, typically the electrodes of the second type, e.g., electrodes 117A-117C and 118A-118C, have a much smaller surface area than that of the electrodes of the first type, e.g., electrodes 115A-115C and 116A-116C, for example on the order of a sixth of the area. Also preferably, the height of electrodes 115A-C, 116A-C, 117A-C, and 118A-C are close to the liquid level of liquid 103 within tank 101. Although the separation distance between electrode pairs is dependent upon a variety of factors (e.g., tank size, voltage/current, etc.), in at least one preferred embodiment the separation of the plane containing electrodes 115A and 117A and the plane containing electrodes 116A and 118A (and similarly, the plane containing 115B and 117B and the plane containing electrodes 116B and 118B; the plane containing 115C and 117C and the plane containing electrodes 116C and 118C) is between 0.2 millimeters and 15 centimeters.

In the embodiment illustrated in FIG. 1, all of the low voltage electrodes are interposed between the high voltage anodes 119A-119C and the high voltage cathodes 120A-120C. In other words, in this embodiment all of the electrolysis cells are interposed between the planes containing the high voltage electrodes, e.g., the plane containing electrodes 119A-119C and the plane containing electrodes 120A-120C. The high voltage electrodes may be larger, smaller or the same size as either type of low voltage electrode. Preferably electrodes 119A-C and 120A-C are fabricated from titanium, although other materials can be used (e.g., steel, copper, iron, stainless steel, cobalt, manganese, zinc, nickel, platinum, palladium, aluminum, lithium, magnesium, boron, carbon, graphite, carbon-graphite, metal hydrides and alloys of these materials).

Preferably the ratio of the high voltage to the low voltage applied to the high voltage and low voltage electrodes, respectively, is at least 5:1, more preferably the ratio is between 5:1 and 100:1, still more preferably the ratio is between 5:1 and 33:1, and even still more preferably the ratio is between 5:1 and 20:1. Preferably the high voltage generated by source 123 is within the range of 50 volts to 50 kilovolts, and more preferably within the range of 100 volts to 5 kilovolts. Preferably the low voltage generated by source 121 is within the range of 3 volts to 1500 volts, and more preferably within the range of 12 volts to 750 volts.

Rather than continually apply voltage to the electrodes, sources 121 and 123 are pulsed, preferably at a frequency between 50 Hz and 1 MHz, and more preferably at a frequency of between 100 Hz and 10 kHz. The pulse width (i.e., pulse duration) is preferably between 0.01 and 75 percent of the time period defined by the frequency, and more preferably between 1 and 50 percent of the time period defined by the frequency. Thus, for example, for a frequency of 150 Hz, the pulse duration is preferably in the range of 0.67 microseconds to 5 milliseconds, and more preferably in the range of 66.7 microseconds to 3.3 milliseconds. Alternately, for example, for a frequency of 1 kHz, the pulse duration is preferably in the range of 0.1 microseconds to 0.75 milliseconds, and more preferably in the range of 10 microseconds to 0.5 milliseconds. Additionally, the voltage pulses are applied simultaneously to the high voltage and low voltage electrodes via sources 123 and 121, respectively. In other words, the voltage pulses applied to high voltage electrodes 119A-C/120A-C coincide with the pulses applied to low voltage electrodes 115A-C/116A-C/117A-C/118A-C. Although voltage sources 121 and 123 can include internal means for pulsing the respective outputs from each source, preferably an external pulse generator 125 controls a pair of switches, i.e., low voltage switch 127 and high voltage switch 129 which, in turn, control the output of voltage sources 121 and 123 as shown, and as described above.

As previously noted, the electrolysis process of the invention generates considerable heat. It will be appreciated that if the system is allowed to become too hot for a given pressure, the liquid within the tank will begin to boil. Additionally, various system components may be susceptible to heat damage. Although the system can be turned off and allowed to cool when the temperature exceeds a preset value, this is not a preferred approach due to the inherent inefficiency of stopping the process, allowing the system to cool, and then restarting the system. Accordingly in the preferred embodiments of the invention the system includes means to actively cool the system to within an acceptable temperature range. For example, in at least one preferred embodiment the cooling system does not allow the temperature to exceed 90° C. Although it will be appreciated that the invention is not limited to a specific type of cooling system or a specific implementation of the cooling system, in at least one embodiment the electrolysis tank is surrounded by a coolant conduit 131, portions of which are shown in FIGS. 1-10, 14 and 15. Within coolant conduit 131 is a heat transfer medium, for example water. Coolant conduit 131 can either surround a portion of the electrolysis tank as shown, or be contained within the electrolysis tank, or be integrated within the walls of the electrolysis tank. The coolant pump and heat withdrawal system is not shown in the figures as cooling systems are well known by those of skill in the art.

As will be appreciated by those of skill in the art, there are numerous minor variations of the system described above that will function in accordance with the invention. For example, system 200 shown in FIG. 2 utilizes the same number of electrodes and the same types of electrodes as used in system 100, however system 200 includes five electrolysis cells. In this embodiment the polarity of the low voltage electrodes alternates, thus requiring five membranes 201A-201E, one membrane positioned between each group of low voltage electrodes. One advantage of this configuration is that most of the low voltage electrodes are used in two cells, rather than in a single cell, thus in general increasing the system efficiency. For example, in system 100 low voltage cathode 116B is primarily used in the cell defined by membrane 105B. In contrast, in system 200 low voltage cathode 116B is a low voltage cathode for two cells, one defined by membrane 201C and one defined by membrane 201D.

Figure 3:
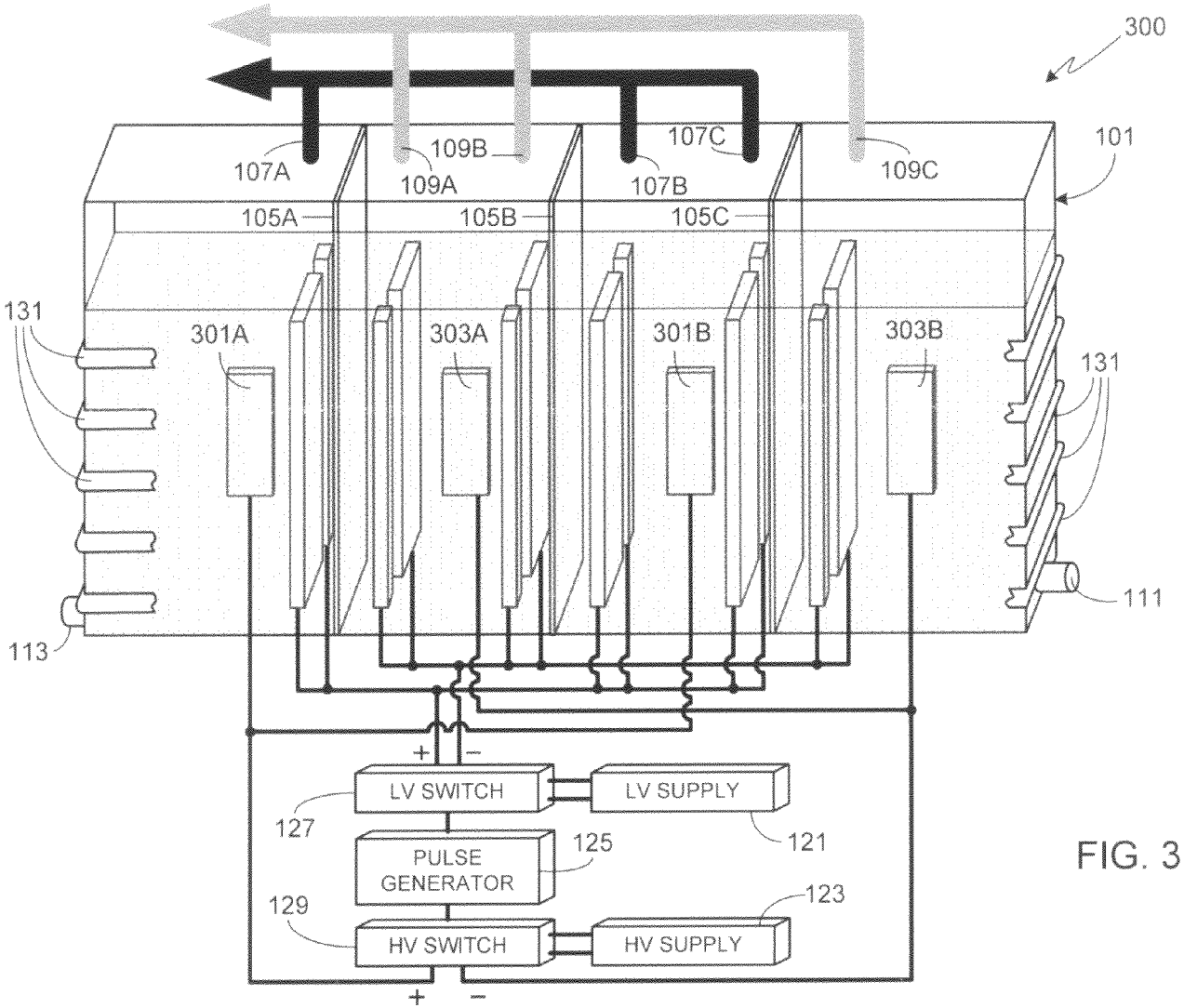
FIG. 3 is an illustration of an alternate embodiment based on the configuration shown in FIG. 1 in which a high voltage electrode is positioned within each electrolysis cell.

FIG. 3 illustrates another alternate configuration based on system 100, system 300 using a high voltage electrode within each region of each cell. In particular, high voltage anode 301A is positioned within the same region as low voltage anodes 115A and 117A; high voltage cathode 303A is positioned within the same region as low voltage cathodes 116A, 116B, 118A and 118B; high voltage anode 301B is positioned within the same region as low voltage anodes 115B, 115C, 117B and 117C; and high voltage cathode 303B is positioned within the same region as low voltage cathodes 116C and 118C. System 400 shown in FIG. 4 is similar to that of system 300 except that each region includes a pair of high voltage electrodes, one high voltage electrode positioned on either side of the cell.

Figure 2:
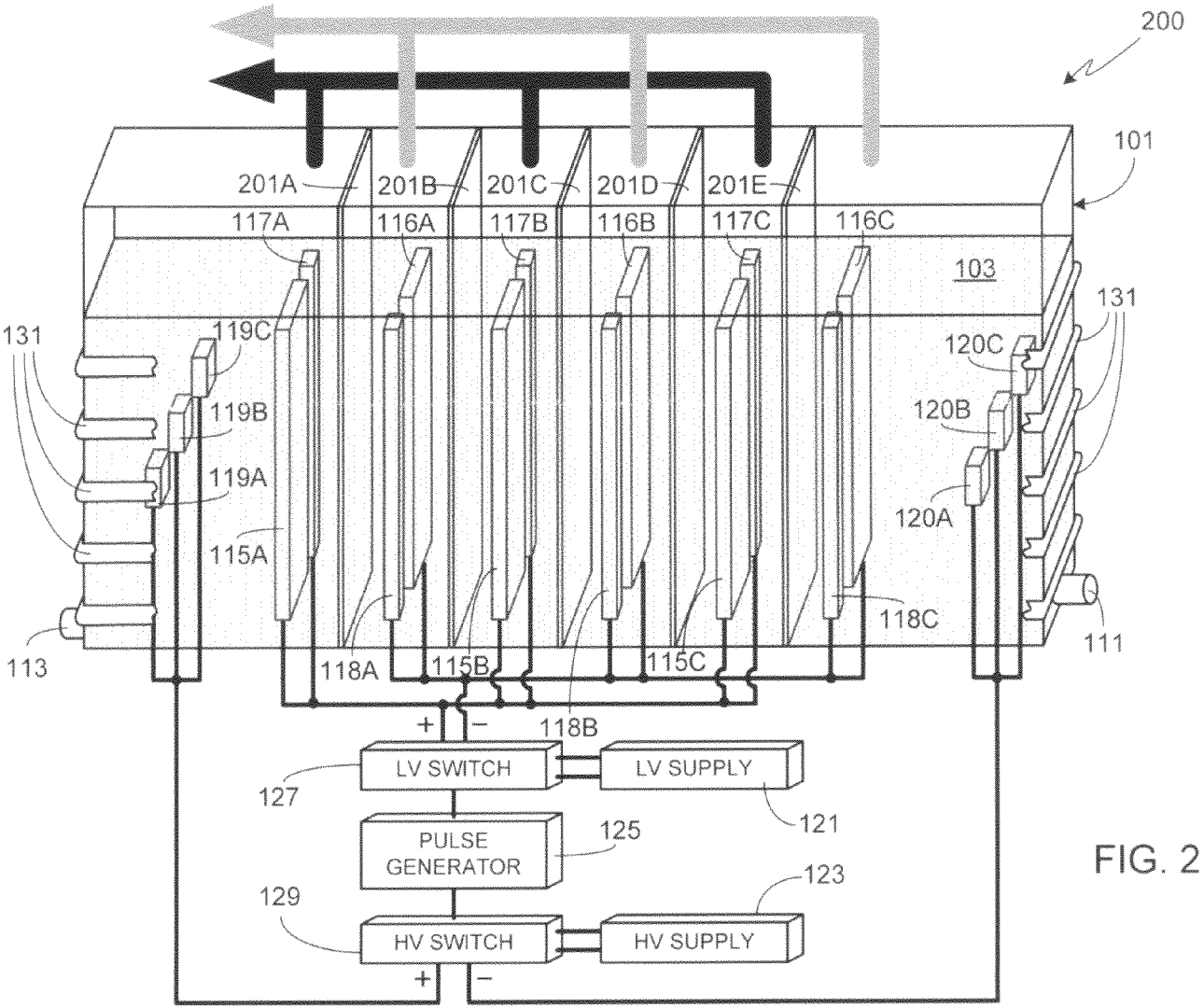
FIG. 2 is an illustration of an exemplary embodiment utilizing the same number and type of electrodes as in the configuration shown in FIG. 1, but in a five cell configuration.
Figure 4:
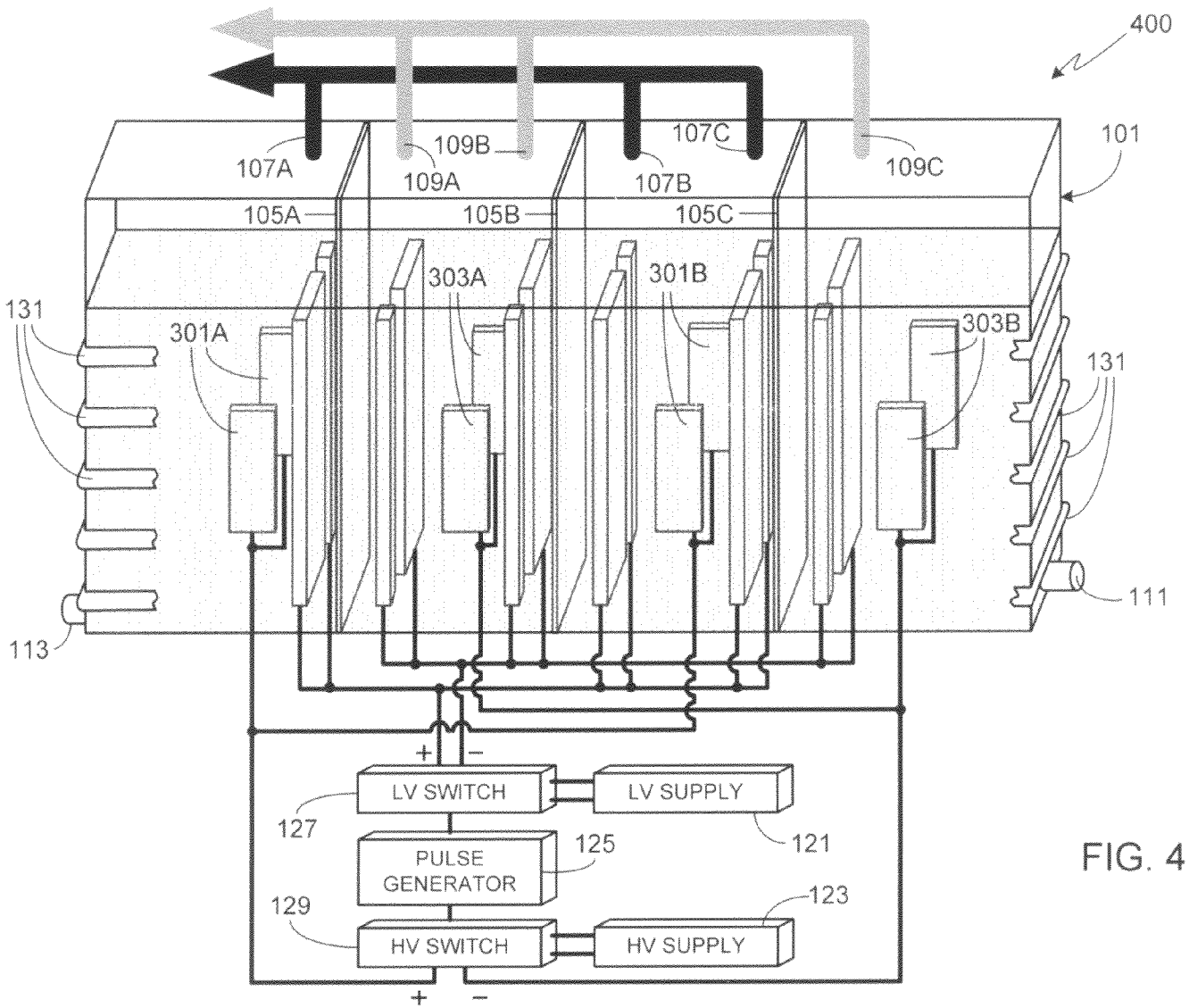
FIG. 4 is an illustration of an alternate embodiment based on the configuration shown in FIG. 1 in which a pair of high voltage electrodes is positioned within each electrolysis cell.
Figure 5:
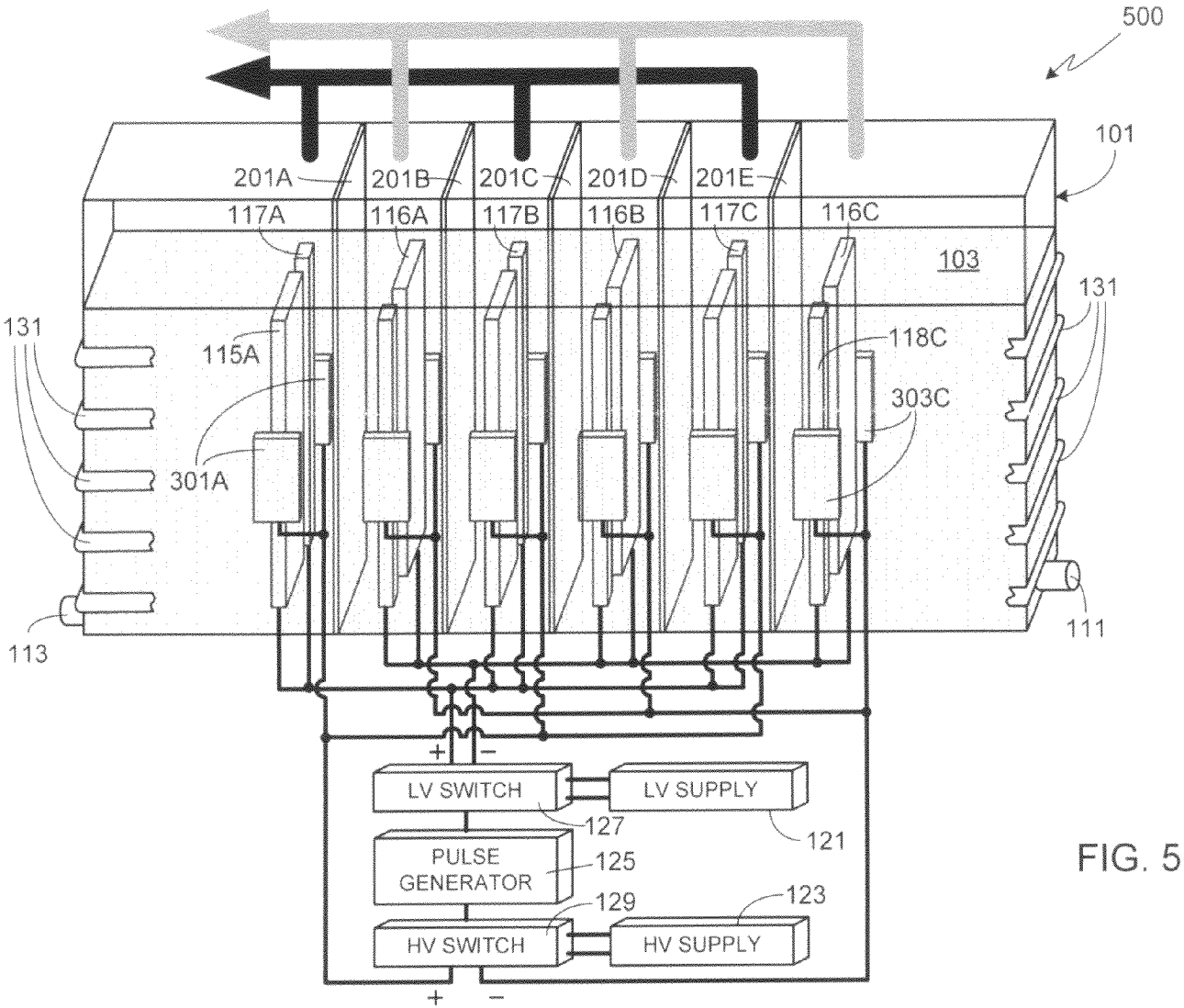
FIG. 5 is an illustration of an alternate embodiment combining the cell configuration shown in FIG. 2 with the high voltage electrode configuration shown in FIG. 4.

FIG. 5 illustrates another alternate configuration combining the cell arrangement shown in FIG. 2 with the high voltage electrode arrangement shown in FIG. 4. It will be appreciated that the configurations illustrated in FIGS. 1-5 are but a few of the possible configurations. For example, any of these configurations can utilize fewer or greater numbers of cells.

Figure 6:
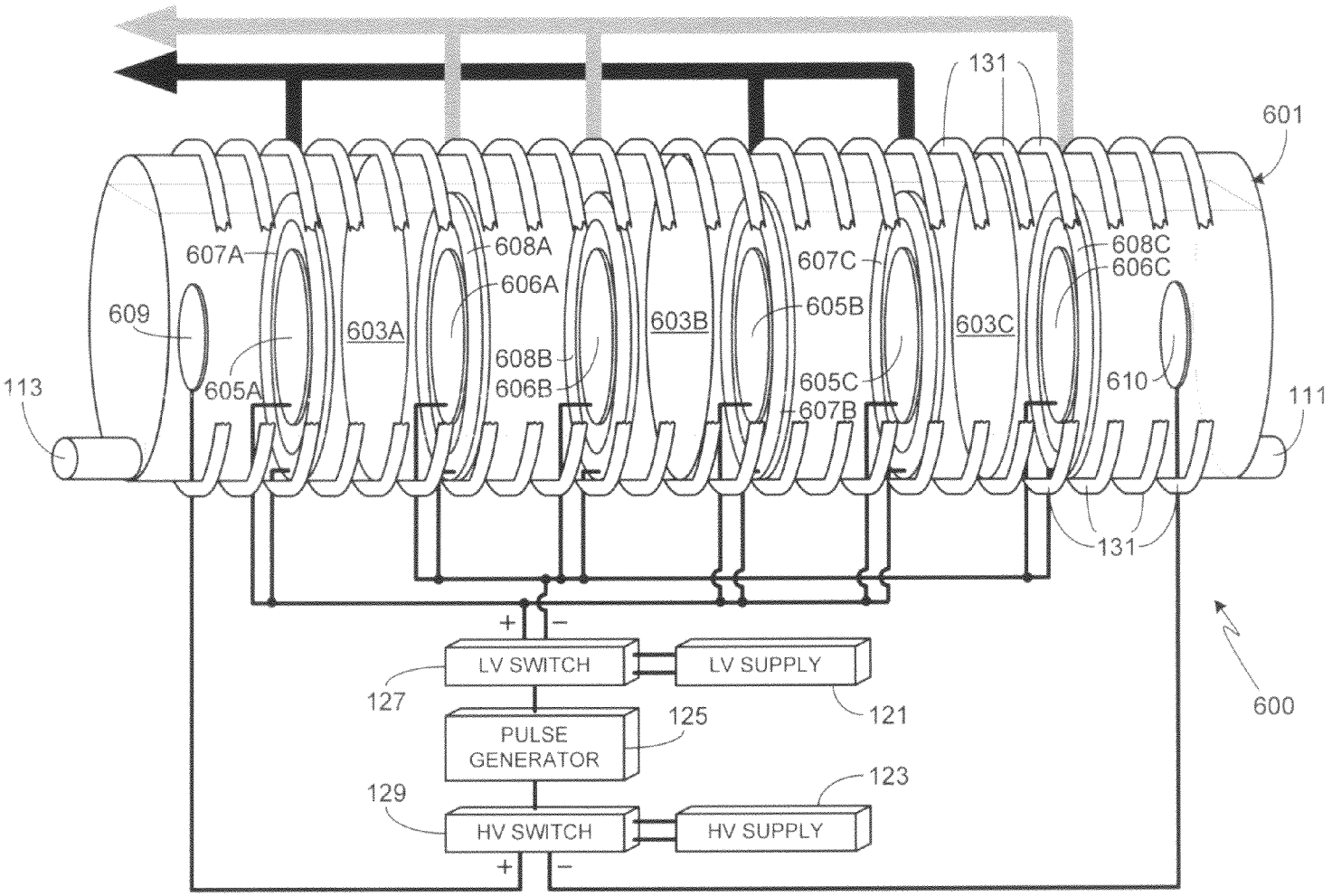
FIG. 6 is an illustration of an alternate embodiment utilizing a cylindrically-shaped tank.

In addition to a variety of cell configurations, as previously noted the invention can utilize differently sized/shaped tanks, various water/electrolyte solutions, a range of high and low voltages, a range of pulse frequencies and a variety of different pulse widths. FIG. 6 illustrates an exemplary embodiment utilizing a few of the possible variations. Specifically, system 600 uses a cylindrically-shaped tank 601. As in system 100, this system has three cells. Additionally, this embodiment replaces membranes 105A-105C with membranes 603A-603C; replaces low voltage anodes 115A-115C with low voltage disc-shaped anodes 605A-605C; replaces low voltage cathodes 116A-116C with low voltage disc-shaped cathodes 606A-606C; replaces low voltage anodes 117A-117C with low voltage ring-shaped anodes 607A-607C; replaces low voltage cathodes 118A-118C with low voltage ring-shaped cathodes 608A-608C; replaces high voltage anodes 119A-119C with high voltage disc-shaped anode 609; and replaces high voltage cathodes 120A-120C with high voltage disc-shaped cathode 610.

Figure 7:
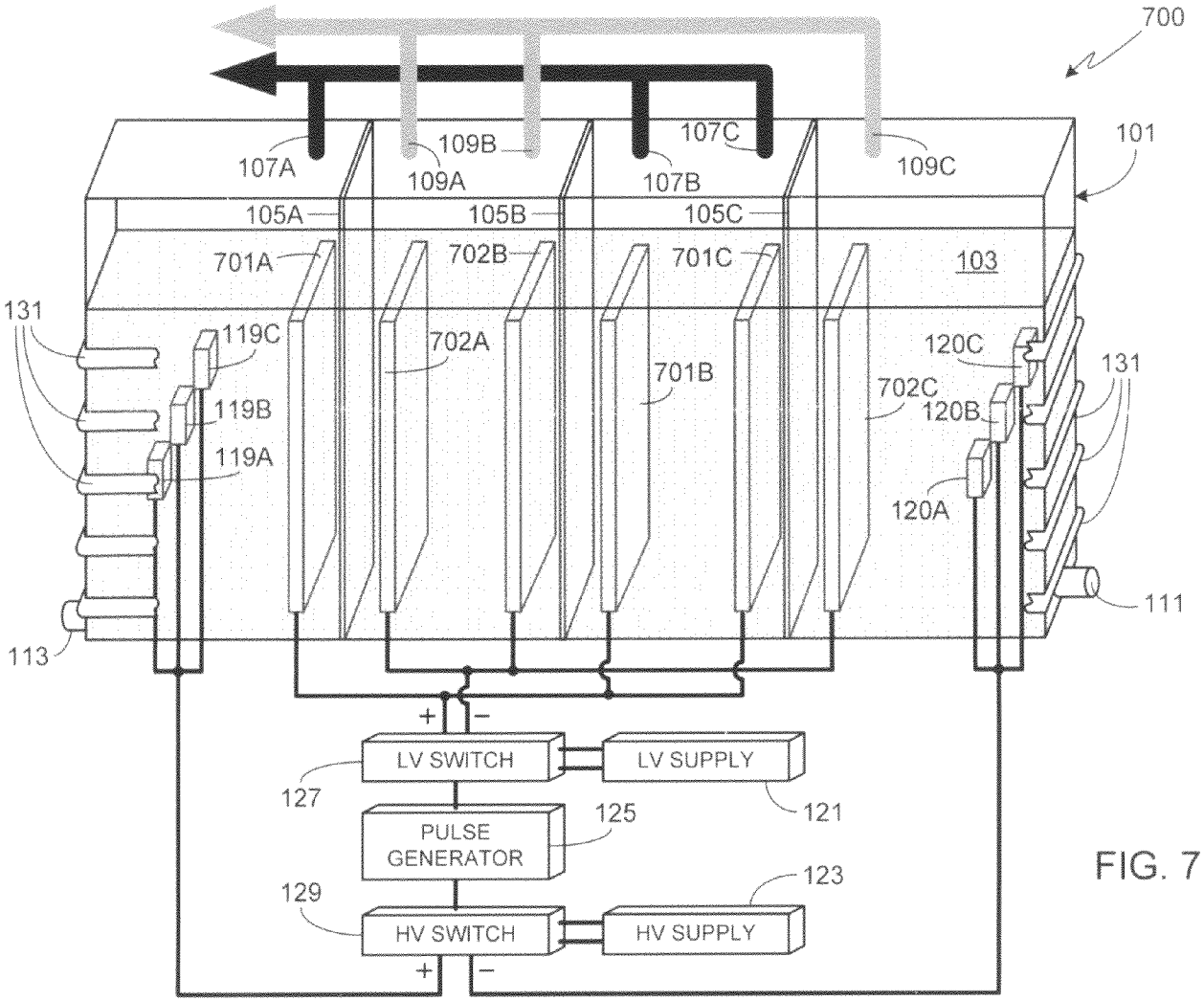
FIG. 7 is an illustration of an alternate embodiment utilizing a single type of low voltage electrode.

Although the use of two different types of low voltage electrodes as previously described is preferred, the multi-cell configuration of the invention can also be used to improve the performance of electrolysis systems that use a single type of low voltage electrode. For example, FIG. 7 illustrates an exemplary embodiment similar to the embodiment shown in FIG. 1 except that it uses a single type of low voltage electrode. Each cell includes at least one low voltage anode (e.g., electrodes 701A-701C in FIG. 7) and at least one low voltage cathode (e.g., electrodes 702A-702C). As with the previous embodiment, various electrode configurations (i.e., number, size, shape, material, polarity configuration) can be used without departing from the invention. For example, but not shown in FIG. 7, each cell can use multiple low voltage electrodes of the same type, shaped electrodes, different size electrodes, etc. Note that the low voltage electrodes are preferably made from titanium or stainless steel, but as in the previous embodiment the electrodes can be fabricated from any of a variety of other materials including copper, iron, stainless steel, cobalt, manganese, zinc, nickel, platinum, palladium, aluminum, lithium, magnesium, boron, carbon, graphite, carbon-graphite, metal hydrides and alloys of these materials. Preferably the area of the face of each low voltage electrode in a cell, or the combined area if the configuration uses multiple low voltage anodes and/or cathodes for each cell, covers a large percentage of the cross-sectional area of the electrolysis tank, typically on the order of at least 40 percent of the cross-sectional area of the tank, and often between approximately 70 percent and 90 percent of the cross-sectional area of the tank. Low voltage electrode spacing in each cell is typically the same as in the two low voltage type configurations.

Figure 8:
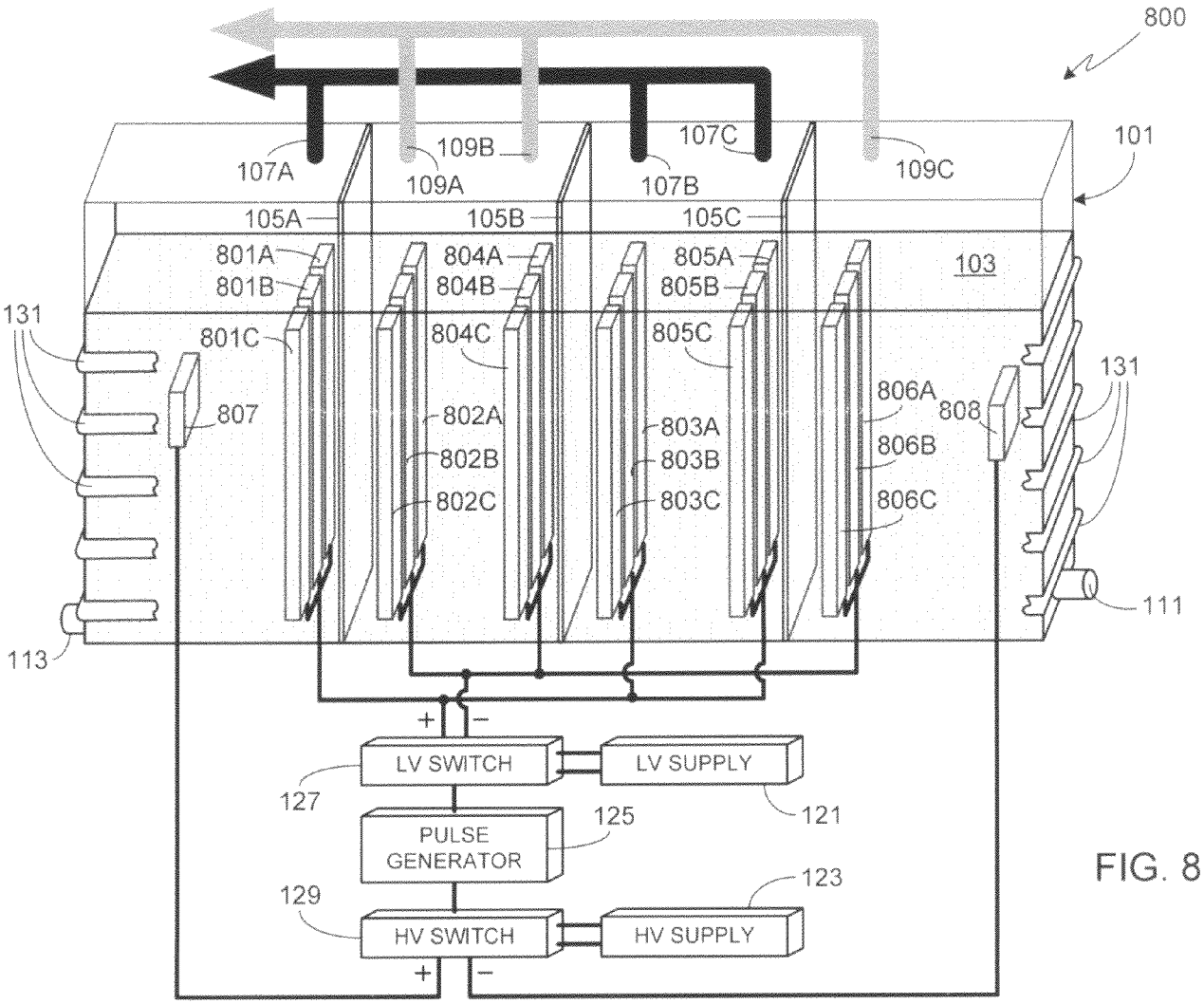
FIG. 8 is an illustration of an alternate embodiment utilizing three low voltage anodes and three low voltage cathodes for each cell and a single pair of high voltage electrodes.

It will be appreciated that as most of the requirements placed on the electrolysis system are the same regardless of whether the system uses one type of low voltage electrode or two, a multi-cell system can be designed which can easily be reconfigured from one type of low voltage electrode to two types, or vice versa. In particular, both electrolysis system configurations have the same requirements regarding electrode size and positioning, applied high voltage, applied low voltage, frequency, pulse duration, electrolysis liquid, electrolyte, membrane composition, and the use of an active cooling system (e.g., coolant conduits 131). FIG. 8 is an illustration of a multi-cell configuration based on the embodiment of FIG. 1 in which each cell includes three low voltage anodes and three low voltage electrodes. In particular, the first cell of system 800 includes low voltage anodes 801A-801C and low voltage cathodes 802A-802C; the second cell includes low voltage anodes 803A-803C and low voltage cathodes 804A-804C; and the third cell includes low voltage anodes 805A-805C and low voltage cathodes 806A-806C. Although multiple high voltage electrodes can be used as in system 100, this embodiment uses a single high voltage anode 807 and a single high voltage cathode 808. It will be appreciated that system 800 can use only a single type of low voltage electrode or it can use two types of low voltage electrodes, for example by making each "B" labeled electrode of a different material than each "A" labeled and "C" labeled electrode.

Figure 9:
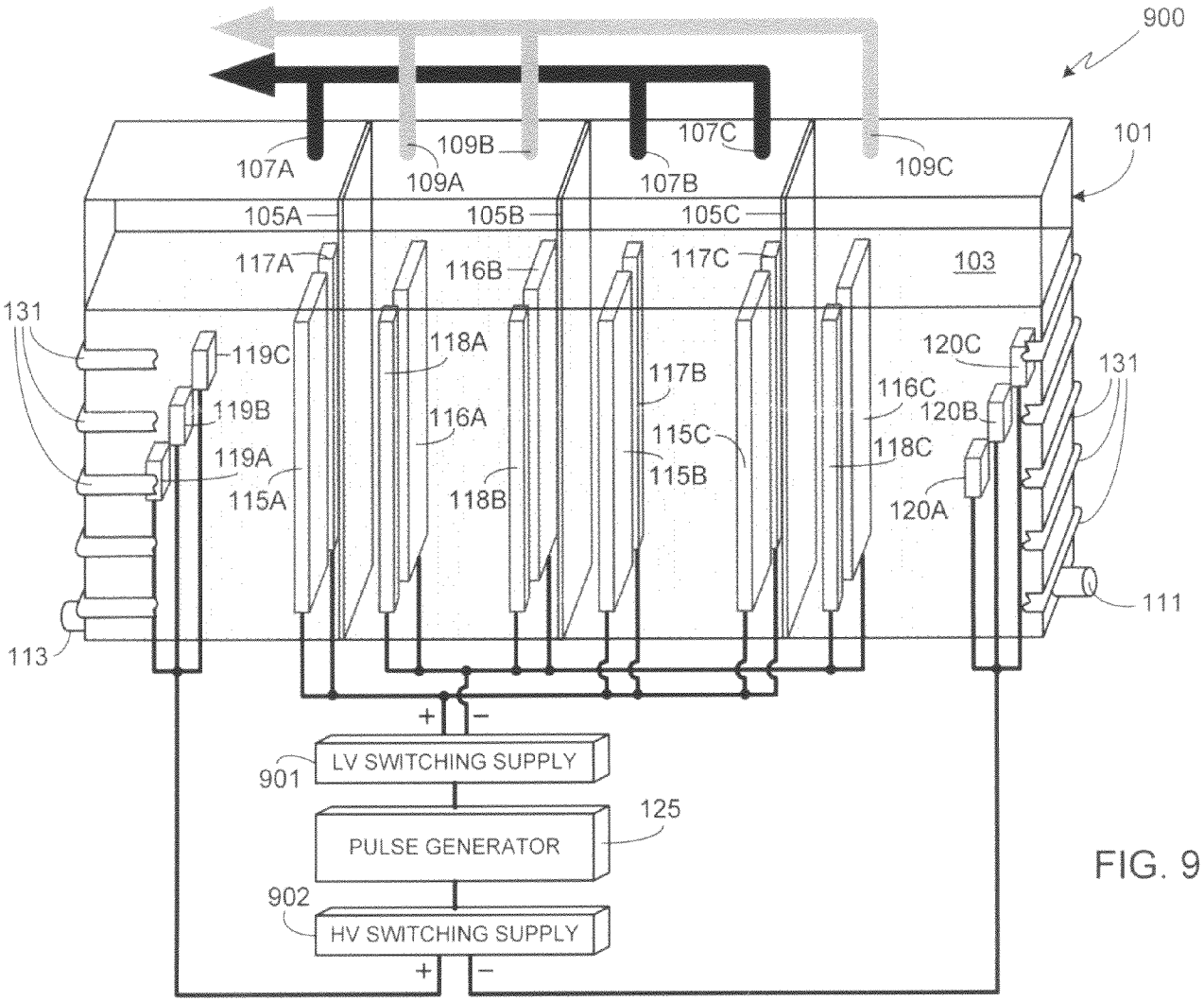
FIG. 9 is an illustration of an alternate embodiment of FIG. 1 utilizing switching power supplies.
Figure 10:
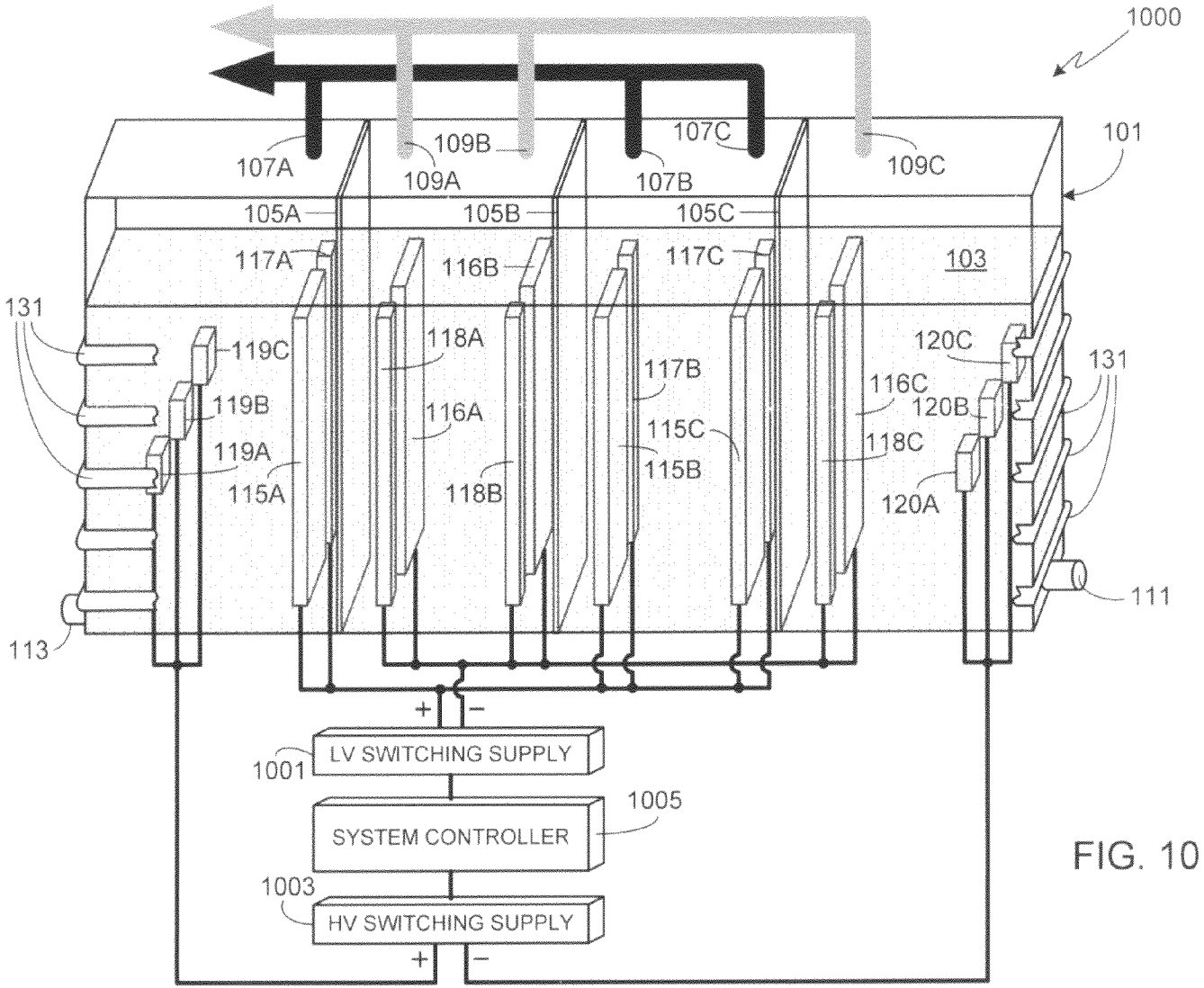
FIG. 10 is an illustration of an alternate embodiment of FIG. 1 utilizing switching power supplies with internal pulse generators.

It will be appreciated that the supply electronics (i.e., low/high voltage supplies, low/high voltage switches, pulse generator) shown in FIGS. 1-8 represent only one exemplary configuration and that other configurations can be used to supply the requisite pulsed and timed power to the low voltage and high voltage electrodes within the cells of the electrolysis system of the invention. For example, alternate configurations can utilize additional power supplies, e.g., for different electrodes, different types of electrodes, or different cells. FIGS. 9 and 10 illustrate two additional alternate, and exemplary, configurations. Specifically, FIG. 9 illustrates a system similar to that shown in FIG. 1, except that low voltage supply 121 and low voltage switch 127 are combined into a single low voltage switching power supply 901. Similarly high voltage supply 123 and high voltage switch 129 are combined into a single high voltage switching power supply 902. System 1000 combines the pulse generation within the power supplies, i.e., low voltage supply 1001 and high voltage supply 1003, and then uses a system controller 1005 to coordinate the low voltage pulses and the high voltage pulses produced by the two systems.

Figure 11:
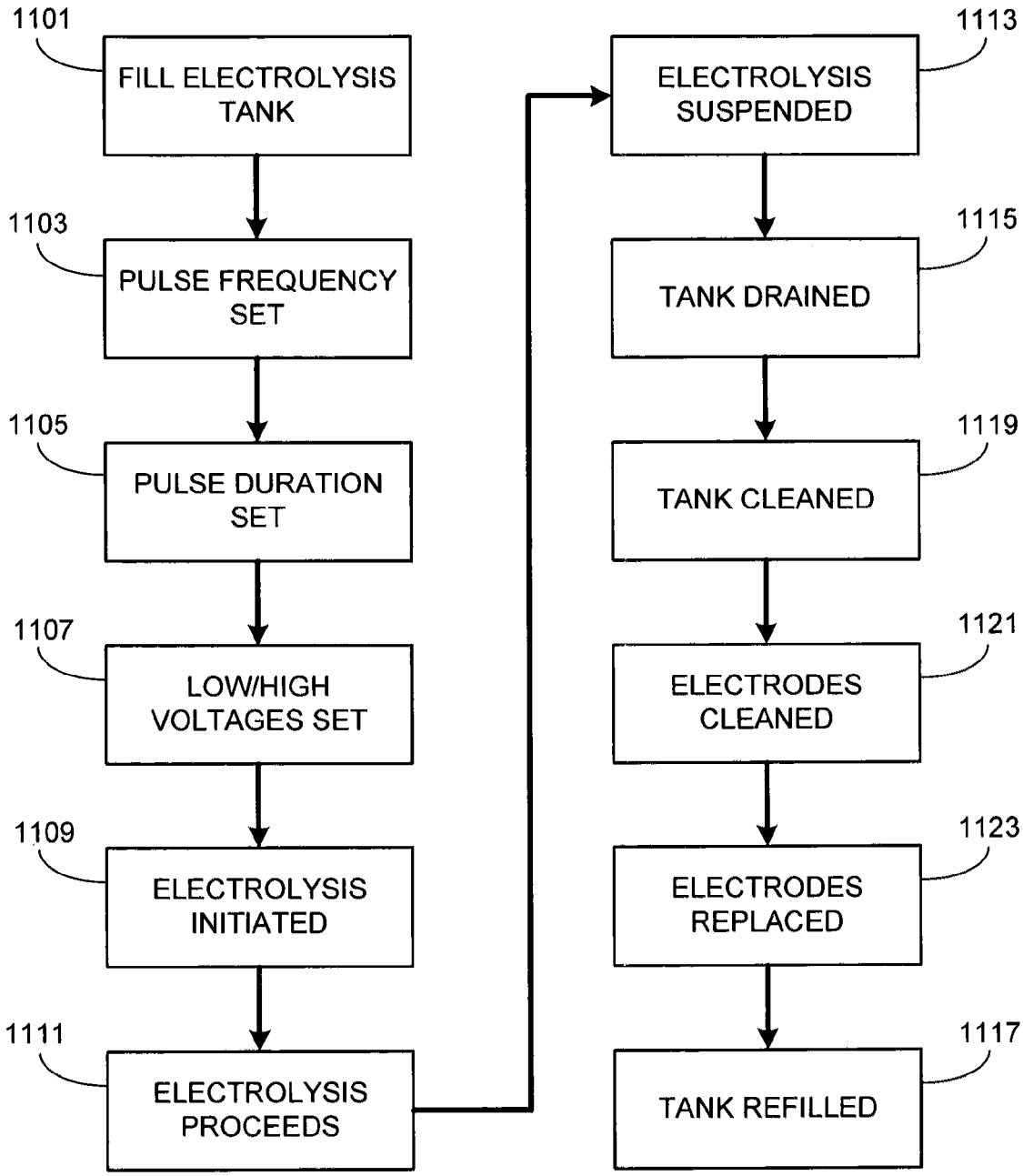
FIG. 11 is an illustration of one mode of operation.

It should be understood that the electrolysis system of the present invention can be operated in a number of modes, the primary differences between modes being the degree of process optimization used during operation. For example, FIG. 11 illustrates one method of operation requiring minimal optimization. As illustrated, initially the electrolysis tank, e.g., tank 101, is filled with water (step 1101). The level of water in the tank preferably just covers the top of the electrodes although the process can also be run with even more water filling the tank. The electrolyte can either be mixed into the water prior to filling the tank or after the tank is filled. The frequency of the pulse generator is then set (step 1103) as well as the pulse duration (step 1105). The initial voltage settings for the low voltage power supply and the high voltage power supply are also set (step 1107). It will be appreciated that the order of set-up is clearly not critical to the electrolysis process. In the preferred approach, prior to the initiation of electrolysis the temperature of the water is at room temperature.

Once set-up is complete, electrolysis is initiated (step 1109). During the electrolysis process (step 1111), and as previously noted, the water is heated by the process itself. Eventually, when operation is no longer desirable, for example when the rate of hydrogen production drops below a user preset level, the electrolysis process is suspended (step 1113). Typically prior to further operation the water is removed from the tank (step 1115) and the tank is refilled (step 1117). Prior to refilling the tank, a series of optional steps can be performed. For example, the tank can be washed out (optional step 1119) and the electrodes can be cleaned, for example to remove oxides, by washing the electrodes with diluted acids (optional step 1121). Spent, or used up, electrodes can also be replaced prior to refilling (optional step 1123). After cleaning the system and/or replacing electrodes as deemed necessary, and refilling the system, the system is ready to reinitiate the electrolysis process.

The above sequence of processing steps works best once the operational parameters have been optimized for a specific system configuration since the system configuration will impact the efficiency of the process (e.g., rate of hydrogen output). Exemplary system configuration parameters that affect the optimal electrolysis settings include tank size, quantity of water, type and/or quality of water, electrolyte composition, electrolyte concentration, electrode size, electrode composition, electrode shape, electrode configuration, electrode separation, cell number, cell separation, initial water temperature, low voltage setting, high voltage setting, pulse frequency and pulse duration.

Figure 12:
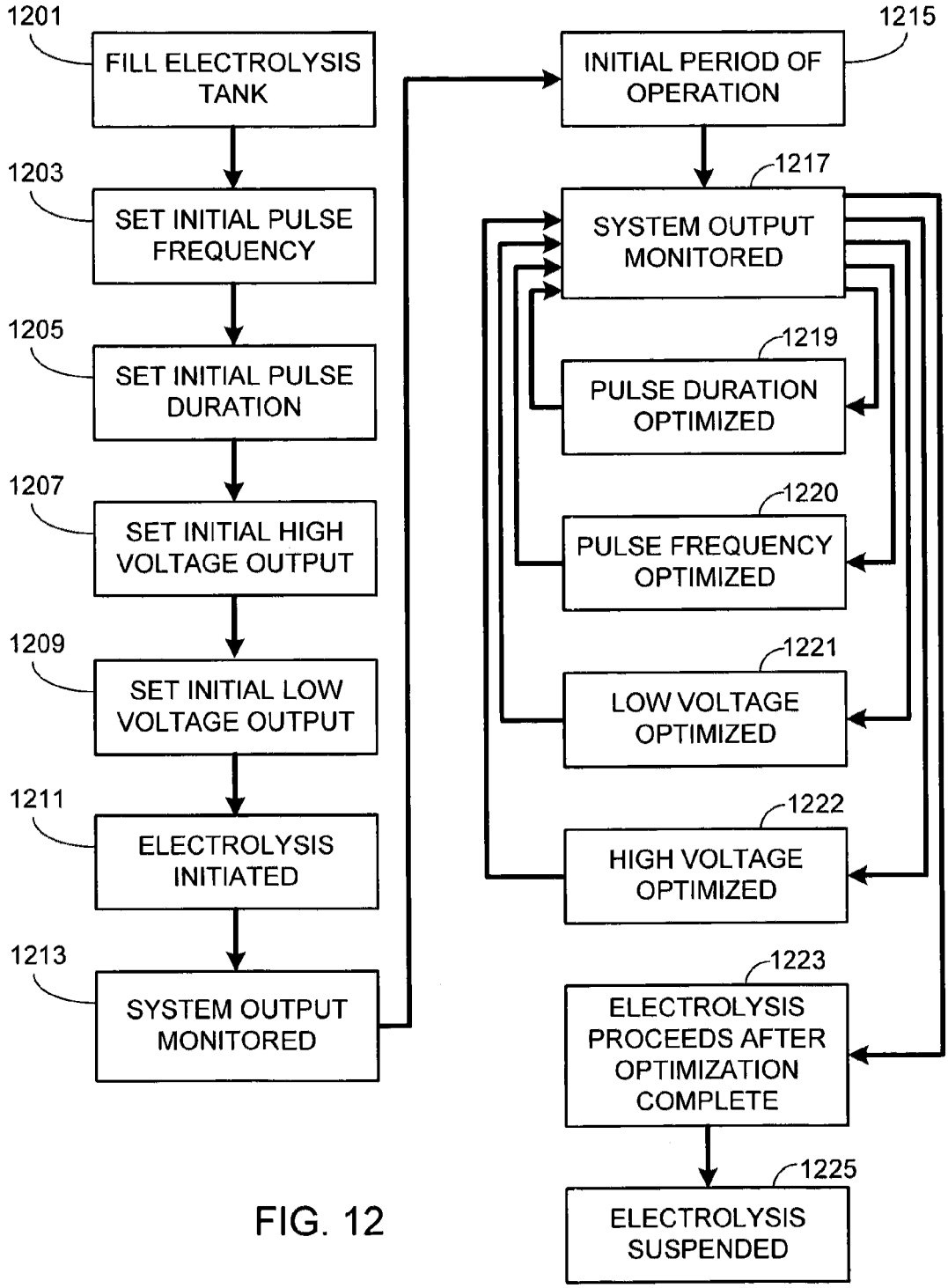
FIG. 12 is an illustration of an alternate mode of operation that includes initial process optimization steps.

FIG. 12 illustrates an alternate procedure, one in which the process undergoes optimization. Initially the tank is filled (step 1201) and initial settings for pulse frequency (step 1203), pulse duration (step 1205), high voltage supply output (step 1207) and low voltage supply output (step 1209) are made. Typically the initial settings are based on previous settings that have been optimized for a similarly configured system. For example, assuming that the new configuration was the same as a previous configuration except for the composition of the electrodes, a reasonable initial set-up would be the optimized set-up from the previous configuration.

After the initial set-up is completed, electrolysis is initiated (step 1211) and system output is monitored (step 1213), for example hydrogen output flow rate. Although system optimization can begin immediately, preferably the system is allowed to run for an initial period of time (step 1215) prior to optimization. The initial period of operation can be based on achieving a predetermined output, for example a specific level of hydrogen flow, or achieving a steady state output (e.g., steady state hydrogen flow rate). Alternately the initial period of time can simply be a predetermined time period, for example 6 hours.

After the initial time period is exceeded, the system output (e.g., hydrogen flow rate) is monitored (step 1217) while optimizing one or more of the operational parameters. Although the order of parameter optimization is not critical, in at least one preferred embodiment the first parameter to be optimized is pulse duration (step 1219). Then the pulse frequency is optimized (step 1220), followed by optimization of the low voltage (step 1221) and the high voltage (step 1222). In this embodiment after optimization is complete the electrolysis process is allowed to continue (step 1223) without further optimization until the process is halted, step 1225, for example due to the rate of hydrogen production dropping below a user preset level. In another, and preferred, alternative approach illustrated in FIG. 13, one or more of optimization steps 1219-1222 are performed continuously throughout the electrolysis process until electrolysis is suspended.

Figure 13:
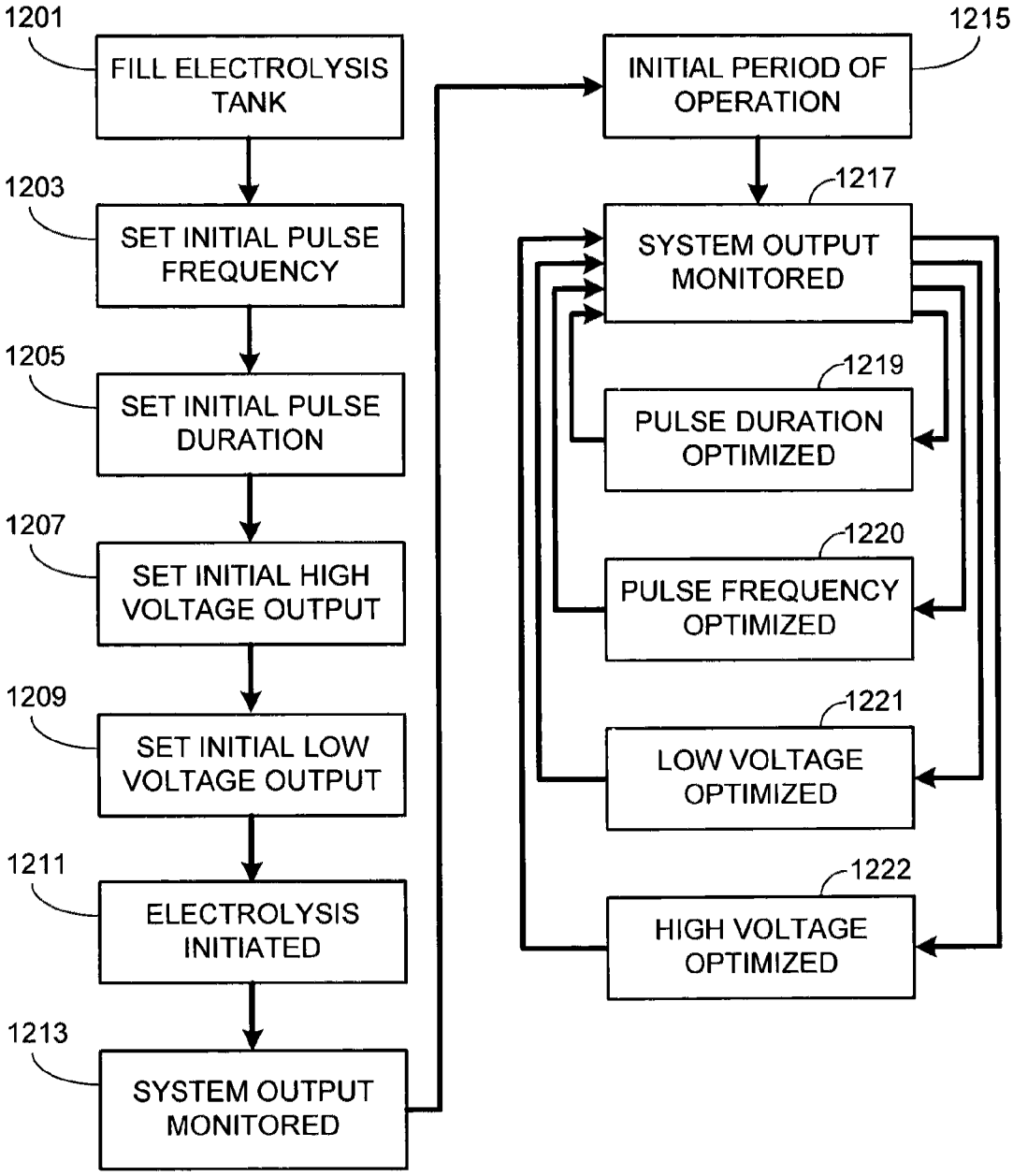
FIG. 13 is an illustration of an alternate, and preferred, mode of operation in which the process undergoes continuous optimization.
Figure 14:
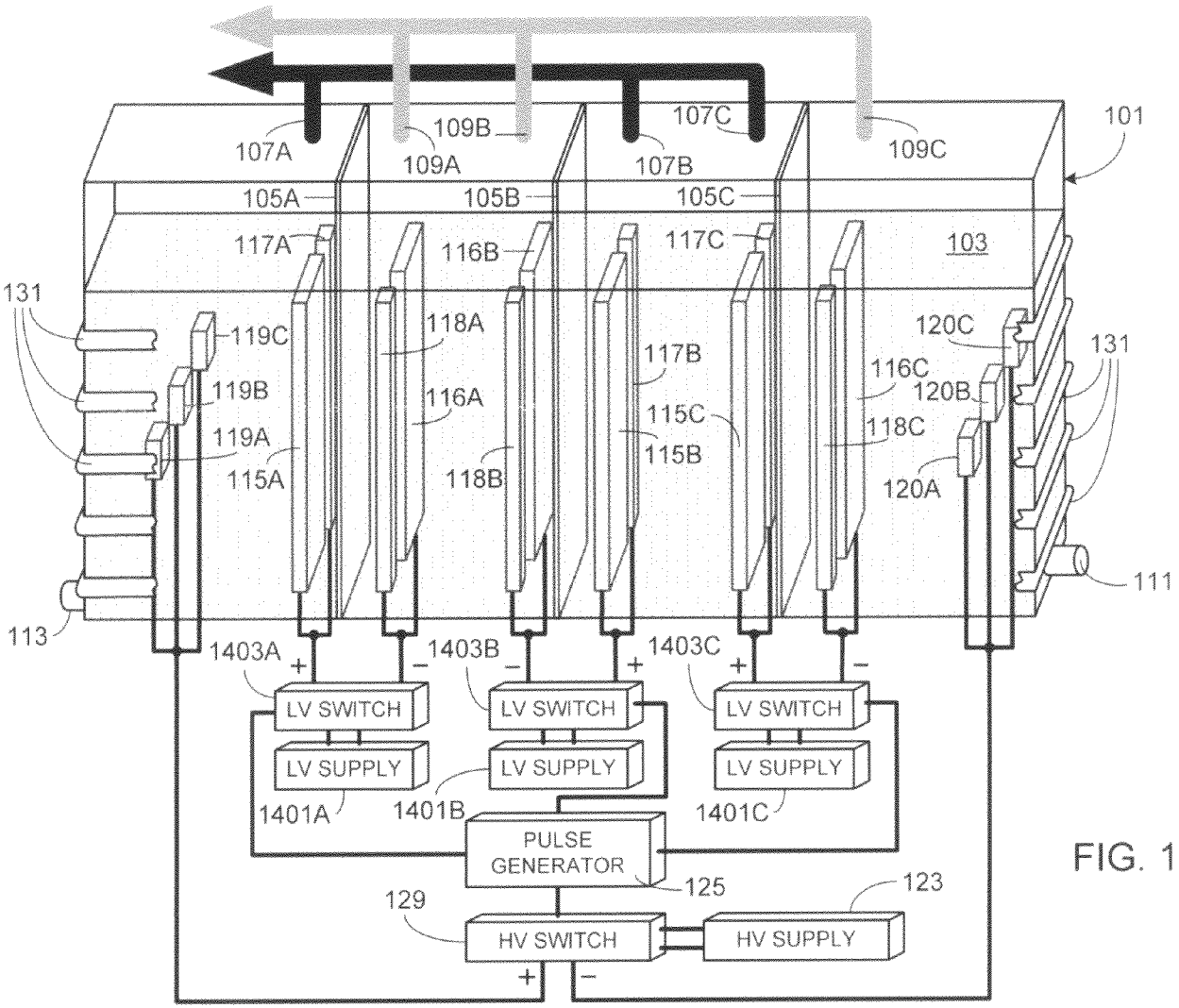
FIG. 14 is an illustration of an alternate embodiment of FIG. 1 utilizing individual low voltage supplies for each cell.
Figure 15:
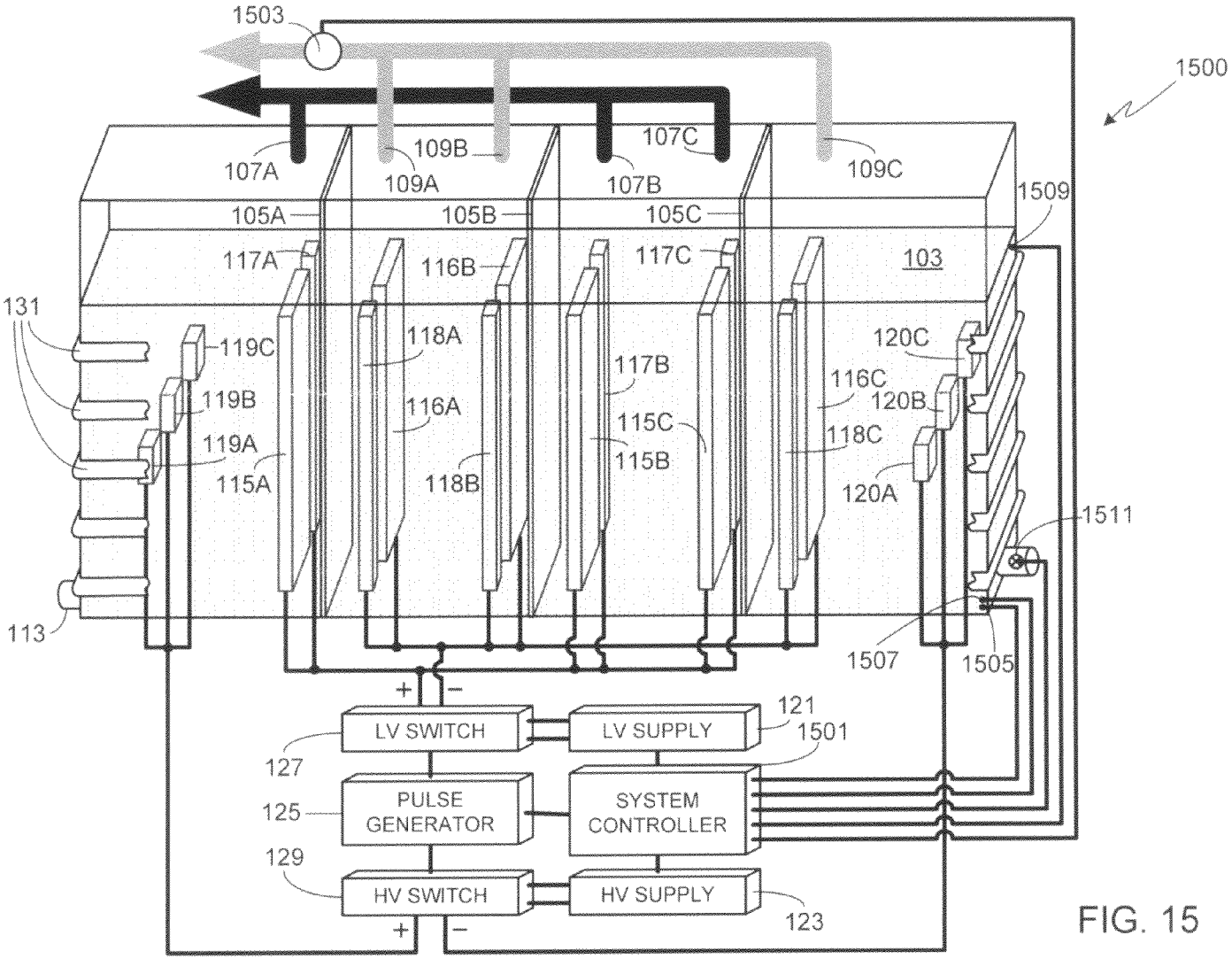
FIG. 15 is an illustration of an alternate embodiment of FIG. 1 that includes a system controller.

Note that the optimization processes described relative to FIGS. 12 and 13 assume that (i) the cells physical geometry is fixed and (ii) there is no control over the low voltage applied to individual cells. If the system does include means for adjusting the physical geometry of the individual cells during electrolysis, for example the spacing between the low voltage electrodes within the cells or the cell-to-cell spacing, these parameters can also be altered to further optimize the electrolysis process during system operation. More typically, the system is configured to provide control over the low voltage applied to individual cells as shown in FIG. 14. As illustrated in this embodiment, corresponding to each cell is a low voltage power supply 1401A-1401C with associated low voltage switch 1403A-1403C. As a result of this configuration, during optimization step 1221 the low voltage applied to each individual cell can be optimized.

The optimization process described relative to FIGS. 12 and 13 can be performed manually. In the preferred embodiment, however, the system or portions of the system are controlled via a system controller such as controller 1501 shown in an alternate embodiment of the configuration illustrated in FIG. 1 (i.e., FIG. 15). Assuming that controller 1501 is used to control and optimize the pulse frequency, pulse duration, high voltage and low voltage, system controller 1501 is coupled to the pulse generator and the voltage supplies as shown. If the system controller is only used to control and optimize a subset of these parameters, the system controller is coupled accordingly (i.e., coupled to the pulse generator to control pulse frequency and duration; coupled to the high voltage source to control the high voltage; coupled to the low voltage source to control the low voltage). In order to allow optimization automation, system controller 1501 is also coupled to a system monitor, for example a flow rate monitor 1503 as shown. System controller 1501 can also be coupled to a one or more temperature monitors 1505 as shown. In at least one preferred embodiment system controller 1501 is also coupled to a monitor 1507, monitor 1507 providing either the pH or the resistivity of liquid 103 within electrolysis tank 101, thereby providing means for determining when additional electrolyte needs to be added. In at least one preferred embodiment system controller 1501 is also coupled to a liquid level monitor 1509, thereby providing means for determining when additional water needs to be added to the electrolysis tank. Preferably system controller 1501 is also coupled to one or more flow valves 1511 which allow water, electrolyte, or a combination of water and electrolyte to be automatically added to the electrolysis system in response to pH/resistivity data provided by monitor 1507 (i.e., when the monitored pH/resistivity falls outside of a preset range) and/or liquid level data provided by monitor 1509 (i.e., when the monitored liquid level falls below a preset value).

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An electrolysis system comprising:

an electrolysis tank;

a plurality of electrolysis cells within said electrolysis tank, each of said plurality of electrolysis cells comprising:

a membrane dividing said electrolysis cell into a first region and a second region, wherein said membrane permits ion and electron exchange between said first and second regions, and wherein said membrane restricts hydrogen gas flow and oxygen gas flow between said first and second regions;

at least one pair of low voltage electrodes of a first type and comprised of a first material and including at least one anode of said first type and at least one cathode of said first type; and at least one pair of low voltage electrodes of a second type and comprised of a second material and including at least one anode of said second type and at least one cathode of said second type, wherein said first and second materials are different, and wherein in each electrolysis cell of said plurality of electrolysis cells said at least one anode of said first type and said at least one anode of said second type are located within one of said first and second regions and said at least one cathode of said first type and said at least one cathode of said second type are located within another of said first and second regions;

at least one pair of high voltage electrodes contained within said electrolysis tank, wherein said at least one pair of high voltage electrodes includes at least one high voltage anode and at least one high voltage cathode, wherein all of said plurality of electrolysis cells are positioned between said at least one high voltage anode and said at least one high voltage cathode;

a low voltage source with a first output voltage electrically connected to said at least one pair of low voltage electrodes of said first type of each electrolysis cell and to said at least one pair of low voltage electrodes of said second type of each electrolysis cell;

a high voltage source with a second output voltage electrically connected to said at least one pair of high voltage electrodes, wherein said second output voltage is higher than said first output voltage; and means for simultaneously pulsing said low voltage source and said high voltage source at a specific frequency and a specific pulse duration.

2. The electrolysis system of claim 1, further comprising a liquid within said electrolysis tank, wherein said liquid includes at least one of water, deuterated water, tritiated water, semiheavy water, heavy oxygen water, water containing an isotope of hydrogen, or water containing an isotope of oxygen.

3. The electrolysis system of claim 1, wherein said first material is selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides, wherein said second material is selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides, and wherein each high voltage electrode is comprised of a third material selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

4. A method of operating an electrolysis system comprising the steps of:

positioning a plurality of electrolysis cells within an electrolysis tank, wherein each of said electrolysis cells is comprised of a membrane dividing said electrolysis cell into a first region and a second region, at least one pair of low voltage electrodes of a first type and at least one pair of low voltage electrodes of a second type;

positioning at least one pair of high voltage electrodes within said electrolysis tank, wherein said at least one pair of high voltage electrodes includes at least one high voltage anode and at least one high voltage cathode, wherein all of said plurality of electrolysis cells are positioned between said at least one high voltage anode and said at least one high voltage cathode within said electrolysis tank;

applying a low voltage to said at least one pair of low voltage electrodes of said first type positioned within each of said plurality of electrolysis cells within said electrolysis tank, wherein said low voltage applying step further comprises the step of pulsing said low voltage applied to said at least one pair of low voltage electrodes of said first type at a first frequency and with a first pulse duration;

applying said low voltage to said at least one pair of low voltage electrodes of said second type positioned within each of said plurality of electrolysis cells within said electrolysis tank, wherein said low voltage applying step further comprises the step of pulsing said low voltage applied to said at least one pair of low voltage electrodes of said second type at said first frequency and with said first pulse duration; and applying a high voltage to said at least one pair of high voltage electrodes positioned within said electrolysis tank, wherein said high voltage applying step further comprises the step of pulsing said high voltage at said first frequency and with said first pulse duration, wherein said high voltage apply step is performed simultaneously with said step of pulsing said low voltage applied to said at least one pair of low voltage electrodes of said first type and said step of pulsing said low voltage applied to said at least one pair of low voltage electrodes of said second type.

5. The method of claim 4, further comprising the steps of filling said electrolysis tank with a liquid and selecting said liquid from the group consisting of water, deuterated water, tritiated water, semiheavy water, heavy oxygen water, water containing an isotope of hydrogen, or water containing an isotope of oxygen.

6. The method of claim 4, further comprising the steps of:

fabricating said at least one pair of low voltage electrodes of said first type from a first material;

fabricating said at least one pair of low voltage electrodes of said second type from a second material, wherein said first and second materials are different;

fabricating said at least one pair of high voltage electrodes from a third material; and selecting said first material, said second material and said third material from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

7. An electrolysis system comprising:

an electrolysis tank;

a plurality of electrolysis cells within said electrolysis tank, each of said plurality of electrolysis cells comprising:

a membrane dividing said electrolysis cell into a first region and a second region, wherein said membrane permits ion and electron exchange between said first and second regions, and wherein said membrane restricts hydrogen gas flow and oxygen gas flow between said first and second regions;

at least one pair of low voltage electrodes of a first type and comprised of a first material and including at least one low voltage anode of said first type and at least one low voltage cathode of said first type;

at least one pair of low voltage electrodes of a second type and comprised of a second material and including at least one low voltage anode of said second type and at least one low voltage cathode of said second type, wherein said first and second materials are different; and at least one pair of high voltage electrodes comprised of at least one high voltage anode and at least one high voltage cathode, and wherein in each electrolysis cell of said plurality of electrolysis cells said at least one low voltage anode of said first type and said at least one low voltage anode of said second type and said at least one high voltage anode are located within one of said first and second regions and said at least one low voltage cathode of said first type and said at least one low voltage cathode of said second type and said at least one high voltage cathode are located within another of said first and second regions;

a low voltage source with a first output voltage electrically connected to said at least one pair of low voltage electrodes of said first type of each electrolysis cell and to said at least one pair of low voltage electrodes of said second type of each electrolysis cell;

a high voltage source with a second output voltage electrically connected to said at least one pair of high voltage electrodes of each electrolysis cell, wherein said second output voltage is higher than said first output voltage; and means for simultaneously pulsing said low voltage source and said high voltage source at a specific frequency and a specific pulse duration.

8. The electrolysis system of claim 7, further comprising a liquid within said electrolysis tank, wherein said liquid includes at least one of water, deuterated water, tritiated water, semiheavy water, heavy oxygen water, water containing an isotope of hydrogen, or water containing an isotope of oxygen.

9. The electrolysis system of claim 7, wherein said first material is selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides, wherein said second material is selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides, and wherein each high voltage electrode is comprised of a third material selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

10. A method of operating an electrolysis system comprising the steps of:

positioning a plurality of electrolysis cells within an electrolysis tank, wherein each of said electrolysis cells is comprised of a membrane dividing said electrolysis cell into a first region and a second region, at least one pair of low voltage electrodes of a first type, at least one pair of low voltage electrodes of a second type, and at least one pair of high voltage electrodes;

applying a low voltage to said at least one pair of low voltage electrodes of said first type positioned within each of said plurality of electrolysis cells within said electrolysis tank, wherein said low voltage applying step further comprises the step of pulsing said low voltage applied to said at least one pair of low voltage electrodes of said first type at a first frequency and with a first pulse duration;

applying said low voltage to said at least one pair of low voltage electrodes of said second type positioned within each of said plurality of electrolysis cells within said electrolysis tank, wherein said low voltage applying step further comprises the step of pulsing said low voltage applied to said at least one pair of low voltage electrodes of said second type at said first frequency and with said first pulse duration; and applying a high voltage to said at least one pair of high voltage electrodes positioned within each of said plurality of electrolysis cells within said electrolysis tank, wherein said high voltage applying step further comprises the step of pulsing said high voltage at said first frequency and with said first pulse duration, wherein said high voltage apply step is performed simultaneously with said step of pulsing said low voltage applied to said at least one pair of low voltage electrodes of said first type and said step of pulsing said low voltage applied to said at least one pair of low voltage electrodes of said second type.

11. The method of claim 10, further comprising the steps of filling said electrolysis tank with a liquid and selecting said liquid from the group consisting of water, deuterated water, tritiated water, semiheavy water, heavy oxygen water, water containing an isotope of hydrogen, or water containing an isotope of oxygen.

12. The method of claim 10, further comprising the steps of:

fabricating said at least one pair of low voltage electrodes of said first type from a first material;

fabricating said at least one pair of low voltage electrodes of said second type from a second material, wherein said first and second materials are different;

fabricating said at least one pair of high voltage electrodes from a third material; and selecting said first material, said second material and said third material from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

13. An electrolysis system comprising:

an electrolysis tank;

a plurality of electrolysis cells within said electrolysis tank, each of said plurality of electrolysis cells comprising:

a membrane dividing said electrolysis cell into a first region and a second region, wherein said membrane permits ion and electron exchange between said first and second regions, and wherein said membrane restricts hydrogen gas flow and oxygen gas flow between said first and second regions; and at least one pair of low voltage electrodes comprised of at least one low voltage anode and at least one low voltage cathode, wherein in each electrolysis cell of said plurality of electrolysis cells said at least one low voltage anode is located within one of said first and second regions and said at least one low voltage cathode is located within another of said first and second regions;

at least one pair of high voltage electrodes contained within said electrolysis tank, wherein said at least one pair of high voltage electrodes includes at least one high voltage anode and at least one high voltage cathode, wherein all of said plurality of electrolysis cells are positioned between said at least one high voltage anode and said at least one high voltage cathode;

a low voltage source with a first output voltage electrically connected to said at least one pair of low voltage electrodes of each electrolysis cell;

a high voltage source with a second output voltage electrically connected to said at least one pair of high voltage electrodes, wherein said second output voltage is higher than said first output voltage; and means for simultaneously pulsing said low voltage source and said high voltage source at a specific frequency and a specific pulse duration.

14. The electrolysis system of claim 13, further comprising a liquid within said electrolysis tank, wherein said liquid includes at least one of water, deuterated water, tritiated water, semiheavy water, heavy oxygen water, water containing an isotope of hydrogen, or water containing an isotope of oxygen.

15. The electrolysis system of claim 13, wherein each low voltage electrode of said at least one pair of low voltage electrodes is comprised of a first material selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides, and wherein each high voltage electrode of said at least one pair of high voltage electrodes is comprised of a second material selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

16. A method of operating an electrolysis system comprising the steps of:

positioning a plurality of electrolysis cells within an electrolysis tank, wherein each of said electrolysis cells is comprised of a membrane dividing said electrolysis cell into a first region and a second region, and at least one pair of low voltage electrodes;

positioning at least one pair of high voltage electrodes within said electrolysis tank, wherein said at least one pair of high voltage electrodes includes at least one high voltage anode and at least one high voltage cathode, wherein all of said plurality of electrolysis cells are positioned between said at least one high voltage anode and said at least one high voltage cathode within said electrolysis tank;

applying a low voltage to said at least one pair of low voltage electrodes positioned within each of said plurality of electrolysis cells within said electrolysis tank, wherein said low voltage applying step further comprises the step of pulsing said low voltage applied to said at least one pair of low voltage electrodes at a first frequency and with a first pulse duration; and applying a high voltage to at least one pair of high voltage electrodes positioned within said electrolysis tank, wherein said high voltage applying step further comprises the step of pulsing said high voltage at said first frequency and with said first pulse duration, wherein said high voltage apply step is performed simultaneously with said step of pulsing said low voltage applied to said at least one pair of low voltage electrodes.

17. The method of claim 16, further comprising the steps of filling said electrolysis tank with a liquid and selecting said liquid from the group consisting of water, deuterated water, tritiated water, semiheavy water, heavy oxygen water, water containing an isotope of hydrogen, or water containing an isotope of oxygen.

18. The method of claim 16, further comprising the steps of:

fabricating said at least one pair of low voltage electrodes from a first material;

fabricating said at least one pair of high voltage electrodes from a second material; and selecting said first material and said second material from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

19. An electrolysis system comprising:

an electrolysis tank;

a plurality of electrolysis cells within said electrolysis tank, each of said plurality of electrolysis cells comprising:

a membrane dividing said electrolysis cell into a first region and a second region, wherein said membrane permits ion and electron exchange between said first and second regions, and wherein said membrane restricts hydrogen gas flow and oxygen gas flow between said first and second regions;

at least one pair of low voltage electrodes comprised of at least one low voltage anode and at least one low voltage cathode; and at least one pair of high voltage electrodes comprised of at least one high voltage anode and at least one high voltage cathode, and wherein in each electrolysis cell of said plurality of electrolysis cells said at least one low voltage anode and said at least one high voltage anode are located within one of said first and second regions and said at least one low voltage cathode and said at least one high voltage cathode are located within another of said first and second regions a low voltage source with a first output voltage electrically connected to said at least one pair of low voltage electrodes of each electrolysis cell;

a high voltage source with a second output voltage electrically connected to said at least one pair of high voltage electrodes, wherein said second output voltage is higher than said first output voltage; and means for simultaneously pulsing said low voltage source and said high voltage source at a specific frequency and a specific pulse duration.

20. The electrolysis system of claim 19, further comprising a liquid within said electrolysis tank, wherein said liquid includes at least one of water, deuterated water, tritiated water, semiheavy water, heavy oxygen water, water containing an isotope of hydrogen, or water containing an isotope of oxygen.

21. The electrolysis system of claim 19, wherein each low voltage electrode of said at least one pair of low voltage electrodes is comprised of a first material selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides, and wherein each high voltage electrode of said at least one pair of high voltage electrodes is comprised of a second material selected from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

22. A method of operating an electrolysis system comprising the steps of:

positioning a plurality of electrolysis cells within an electrolysis tank, wherein each of said electrolysis cells is comprised of a membrane dividing said electrolysis cell into a first region and a second region, at least one pair of low voltage electrodes, and at least one pair of high voltage electrodes;

applying a low voltage to said at least one pair of low voltage electrodes positioned within each of said plurality of electrolysis cells within said electrolysis tank, wherein said low voltage applying step further comprises the step of pulsing said low voltage applied to said at least one pair of low voltage electrodes at a first frequency and with a first pulse duration; and applying a high voltage to at least one pair of high voltage electrodes positioned within each of said plurality of electrolysis cells within said electrolysis tank, wherein said high voltage applying step further comprises the step of pulsing said high voltage at said first frequency and with said first pulse duration, wherein said high voltage apply step is performed simultaneously with said step of pulsing said low voltage applied to said at least one pair of low voltage electrodes.

23. The method of claim 22, further comprising the steps of filling said electrolysis tank with a liquid and selecting said liquid from the group consisting of water, deuterated water, tritiated water, semiheavy water, heavy oxygen water, water containing an isotope of hydrogen, or water containing an isotope of oxygen.

24. The method of claim 22, further comprising the steps of:

fabricating said at least one pair of low voltage electrodes from a first material;

fabricating said at least one pair of high voltage electrodes from a second material; and selecting said first material and said second material from the group consisting of steel, nickel, copper, iron, cobalt, manganese, zinc, titanium, platinum, palladium, aluminum, lithium, magnesium, boron, carbon, graphite, metal hydrides and alloys of steel, nickel, copper, iron, cobalt, manganese, zinc, titanium, platinum, palladium, aluminum, lithium, magnesium, boron, carbon, graphite and metal hydrides.

* * * * *